US012213574B1

(12) United States Patent
Varma

(10) Patent No.: US 12,213,574 B1
(45) Date of Patent: Feb. 4, 2025

(54) HAIR BRUSHING DEVICE WITH A HAIR DRYING CAPABILITY

(71) Applicant: Ramit Varma, Encino, CA (US)

(72) Inventor: Ramit Varma, Encino, CA (US)

( * ) Notice: Subject to any disclaimer, the term of this patent is extended or adjusted under 35 U.S.C. 154(b) by 93 days.

(21) Appl. No.: 18/225,905

(22) Filed: Jul. 25, 2023

(51) Int. Cl.

| | |
|---|---|
| ***A45D 20/00*** | (2006.01) |
| ***A46B 5/02*** | (2006.01) |
| ***A46B 9/02*** | (2006.01) |
| ***A46B 15/00*** | (2006.01) |

(52) U.S. Cl.
CPC ..... *A45D 20/00* (2013.01); *A46B 5/02* (2013.01); *A46B 9/023* (2013.01); *A46B 15/0004* (2013.01); *A46B 15/0034* (2013.01); *A46B 15/0048* (2013.01); *A45D 2200/00* (2013.01); *A46B 2200/104* (2013.01)

(58) Field of Classification Search
CPC ..... A45D 24/24; A45D 24/16; A45D 24/30; A45D 20/42; A45D 20/525; A46B 17/065; A46B 15/0002
See application file for complete search history.

(56) References Cited

U.S. PATENT DOCUMENTS

| | | | | |
|---|---|---|---|---|
| 1,169,028 | A * | 1/1916 | Grove | A45D 24/24 132/111 |
| 5,077,914 | A * | 1/1992 | Yamamoto | A46B 5/00 132/109 |
| 6,011,903 | A | 1/2000 | Nosenchuck | |
| 9,854,893 | B2 | 1/2018 | Robinson | |
| 2006/0196075 | A1 | 9/2006 | Santhouse | |
| 2010/0064542 | A1 | 3/2010 | Mulvaney | |
| 2012/0167323 | A1* | 7/2012 | Williams | A46B 9/06 15/160 |
| 2019/0098977 | A1* | 4/2019 | Thiebaut | A45D 20/10 |

FOREIGN PATENT DOCUMENTS

| | | | |
|---|---|---|---|
| CN | 106413658 | * | 1/2021 |
| EP | 3328238 | B1 | 5/2019 |
| EP | 3925481 | B1 | 11/2022 |
| JP | 05007508 | A | 1/1993 |
| WO | 2019/067716 | A9 | 12/2021 |

OTHER PUBLICATIONS

Machine Translation of Morgan et al., Available Jan. 2021.*
Campbell, The New Kérastase Hair Coach Is the Smartest Hair Brush Ever; (website); Jan. 2, 2017; https://www.allure.com/story/kerastase-hair-coach.

* cited by examiner

*Primary Examiner* — Rachel R Steitz
*Assistant Examiner* — Brianne E Kalach
(74) *Attorney, Agent, or Firm* — Caldwell Intellectual Property Law

(57) ABSTRACT

A hair brushing device with a hair drying capability, the hair brushing device includes a brush head, wherein the head includes at least a sensor device configured to detect hair data pertaining to a user, a barrel with a plurality of bristles, and at least a moisture-wicking component disposed within the barrel, wherein the at least a moisture-wicking component is configured to absorb at least a fluid from the user's hair, at least a sensor interface configured to wet at least a surface of the at least a sensor device with the at least a fluid, and a brush handle attached to one end of the brush head, wherein the brush handle is configured to be held by the user.

16 Claims, 7 Drawing Sheets

HAIR BRUSHING DEVICE WITH A HAIR DRYING CAPABILITY

FIELD OF THE INVENTION

The present invention generally relates to the field of hair brushing devices. In particular, the present invention is directed to a hair brushing device with a hair drying capability.

BACKGROUND

Hair care is an essential part of personal grooming and hygiene. Devices and tools such as, without limitation, a hairbrush may be available to help achieve user desired hairstyle. Advanced features may be needed to improve such device's performance and functionality.

SUMMARY OF THE DISCLOSURE

In an aspect, a hair brushing device with a hair drying capability is described. The hair brushing device includes a brush head, wherein the head includes at least a sensor device configured to detect hair data pertaining to a user, a barrel with a plurality of bristles, and at least a moisture-wicking component disposed within the barrel, wherein the at least a moisture-wicking component is configured to absorb at least a fluid from the user's hair, at least a sensor interface configured to wet at least a surface of the at least a sensor device with the at least a fluid, and a brush handle attached to one end of the brush head configured to be held by the user.

In another aspect, a method of using a hair brushing device with a hair drying capability is described. The method includes absorbing, using at least a moisture-wicking component disposed within a barrel with a plurality of bristles, at least a fluid from a user's hair, wetting, using the at least a sensor interface, at least a surface of at least a sensor device with the at least a fluid, and detecting, using the at least a sensor device, hair data pertaining to the user.

These and other aspects and features of non-limiting embodiments of the present invention will become apparent to those skilled in the art upon review of the following description of specific non-limiting embodiments of the invention in conjunction with the accompanying drawings.

BRIEF DESCRIPTION OF THE DRAWINGS

For the purpose of illustrating the invention, the drawings show aspects of one or more embodiments of the invention. However, it should be understood that the present invention is not limited to the precise arrangements and instrumentalities shown in the drawings, wherein.

The drawings are not necessarily to scale and may be illustrated by phantom lines, diagrammatic representations, and fragmentary views. In certain instances, details that are not necessary for an understanding of the embodiments or that render other details difficult to perceive may have been omitted.

DETAILED DESCRIPTION

At a high level, aspects of the present disclosure are directed to a hair brushing device with a hair drying capability. Aspect of the present disclosure can be used to dry a user's hair with the hair brushing device. This is so, at least in part, because the hair brushing device includes a moisture-wicking component configured to absorb at least a fluid from the user's hair. Exemplary embodiments illustrating aspects of the present disclosure are described below in the context of several specific examples.

Figure 1:
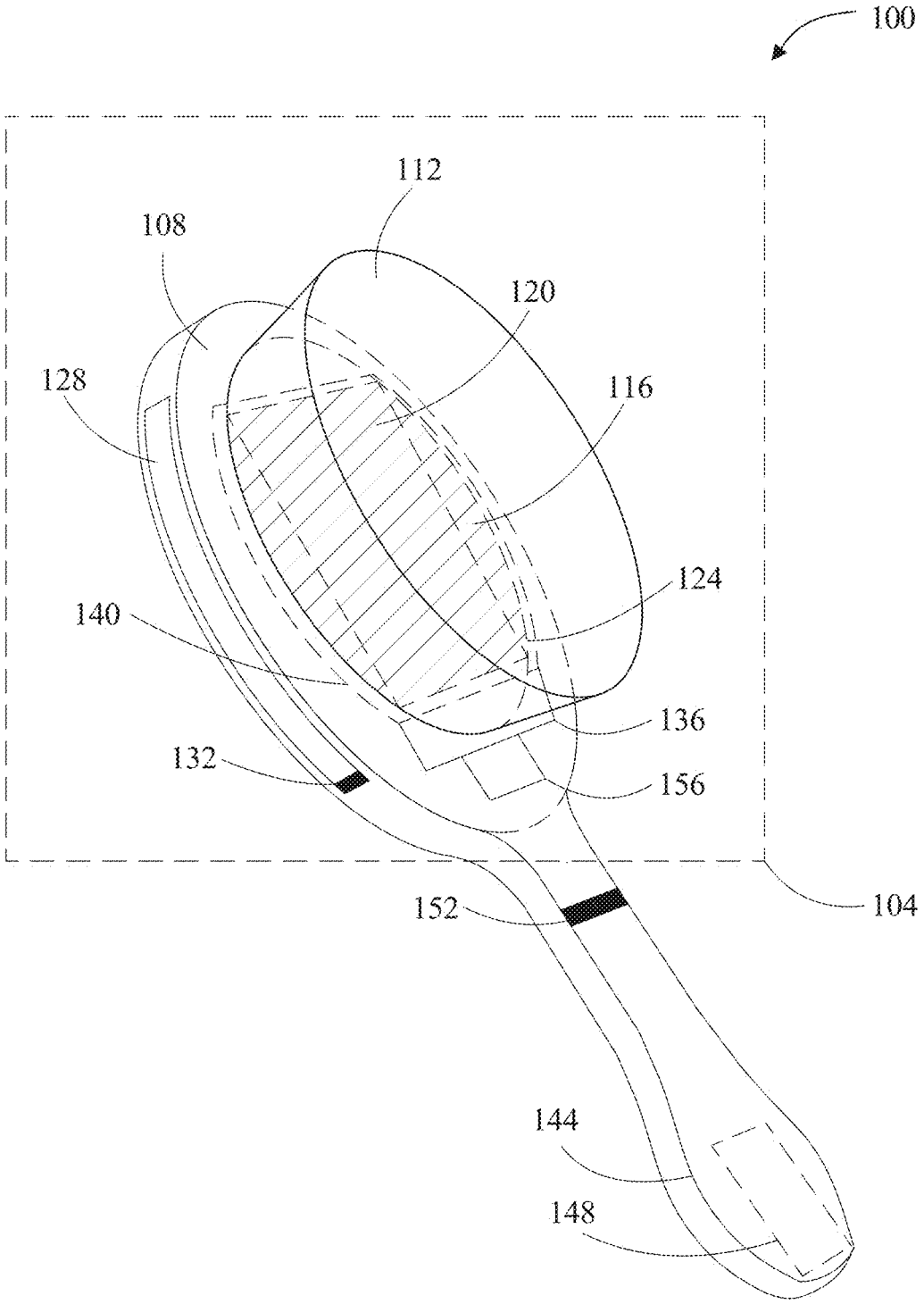
FIG. 1 is an exemplary embodiment of a hair brushing device with a hair drying capability.

Now referring to FIG. 1, an exemplary embodiment of a hair brushing device 100 with a hair drying capability is illustrated. As used in this disclosure, a "hair brushing device" is a device configured to detangle and/or style a user's hair. Hair brushing device includes a brush head 104. A "brush head," for the purpose of this disclosure, is a first part of hair brushing device 100 configured to be in direct contact with a surface being brushed. In some cases, surface may include, without limitation, hair, skin, and/or any other material.

With continued reference to FIG. 1, in some embodiments, brush head 104 may include various shapes. Different shapes of brush head may be used for different functions. For example, and without limitation, brush head 104 may include a rectangular brush head, wherein the rectangular brush head may include a flat shape and straight edges. Such brush head may be used for detangling and smoothing long hair. For another example, and without limitation, brush head 104 may include a round brush head, wherein the round brush head may include a cylindrical shape. Such brush head may be used for creating curls or waves in the hair. Other exemplary embodiments of brush head 104 may include, without limitation, paddle brush head, oval brush head, teardrop brush head, and the like. Persons skilled in the art will be aware, after reviewing the entirety of this disclosure, of different shapes may be used for brush head 104 of hair brushing device configured to detangle and/or style user's hair.

With continued reference to FIG. 1, brush head 104 of hair brushing device 100 includes a barrel 108 with a plurality of bristles 112. As used in this disclosure, a "barrel" is a structural component configured to support the plurality of bristles 112, wherein each "bristle" of plurality of bristles 112 is a filament that protrudes from the surface of brush head 104 and/or barrel 108. In a non-limiting example, barrel 108 may include a frame configured to provide a framework upon which plurality of bristles 112 are anchored. In some cases, barrel 108 may be responsible for the shape and function of brush head 104 as described above. In a non-limiting example, barrel 108 may include a round barrel, wherein the round barrel may include a round brush frame plurality of bristles 112 anchored along the circumference of the round brush frame to the center of round brush frame. In another non-limiting example, barrel 108 may include a paddle barrel. Paddle barrel is described in further detail below in reference to FIG. 4. Other exemplary embodiments of barrel 108 may include, without limitation, vent brush barrel, boar bristle brush barrel, and the like. Persons skilled in the art will be aware, after reviewing the entirety of this disclosure, of different types of barrel be used for brush head 104 of hair brushing device 100 as described herein.

With continued reference to FIG. 1, in some embodiments, plurality of bristles 112 may be made from a variety of materials. In some cases, material of plurality of bristles may be consistent with material of brush head 104 and/or barrel 108; for instance, and without limitation, plastic, metal, wood, and the like thereof. In other cases, material of plurality of bristles may include, without limitation, natural fibers, synthetic fiber, combination of both, and the like.

With continued reference to FIG. 1, in some embodiments, plurality of bristles 112 may include a plurality of short bristles, wherein each short bristle of the plurality of short bristles may be less than 1 inch (2.54 cm) in length. Barrel 108 with plurality of short bristles may be used for creating volume and texture and/or for working on specific sections of user's hair (i.e., short hair). In other embodiments, plurality of bristles 112 may include a plurality of long bristles, wherein each long bristle of the plurality of long bristles may be at least 1 inch (2.54 cm) or longer in length. Barrel 108 with plurality of long bristles may be used for detangling and/or smoothing longer hear. Barrel 108 with plurality of long bristles may be also used for creating sleek, straight styles, and/or adding gentle waves to user's hair. It is to be noted that exact length of plurality of bristles may vary depending on the design and user of hair brushing device 100.

Figure 4:
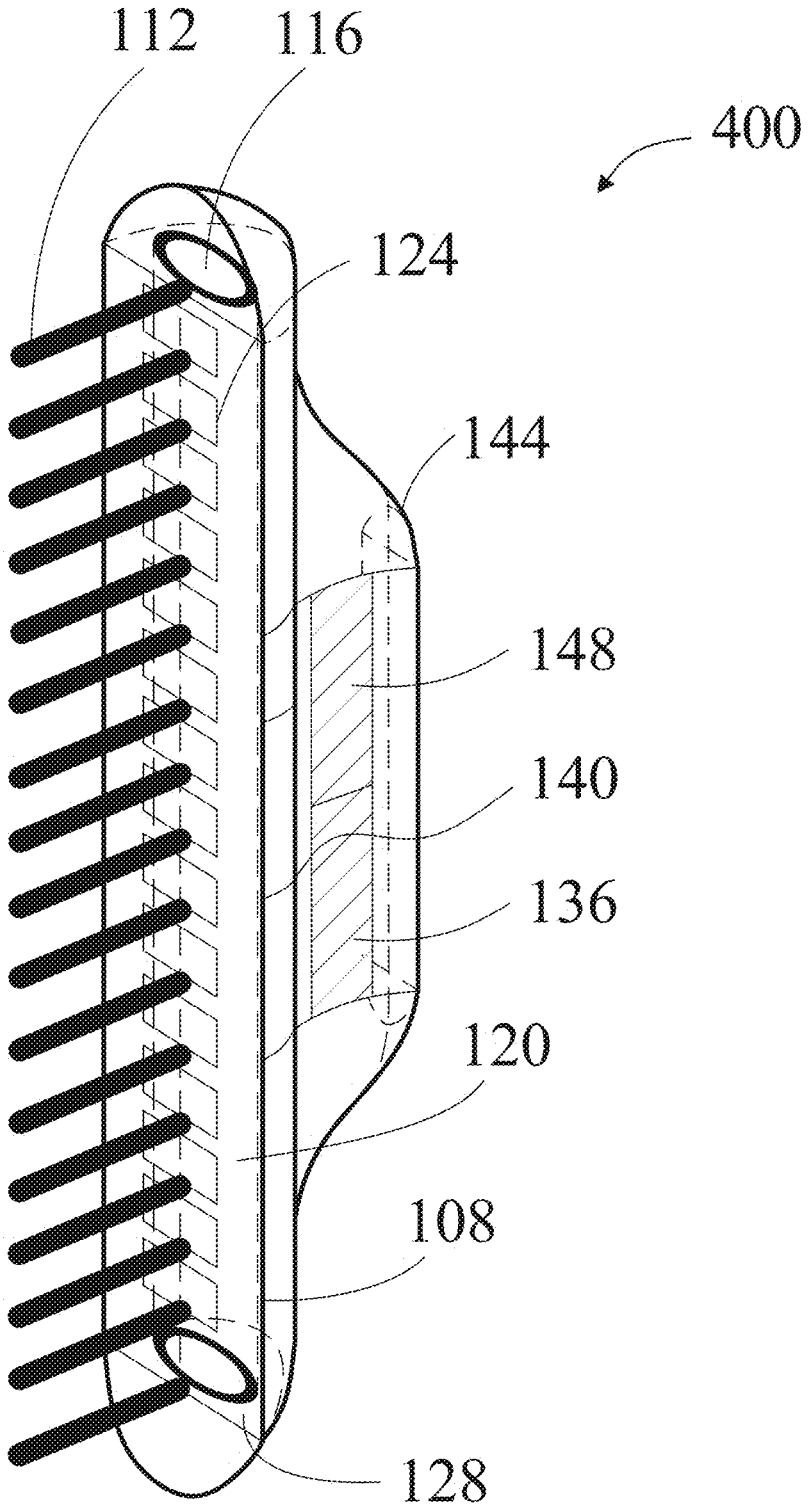
FIG. 4 is an exemplary embodiment of a paddle hairbrush of hair brushing device.

Still referring to FIG. 1, additionally, or alternatively, plurality of bristles 112 may include different shapes (i.e., arrangement). In an embodiments, without limitation plurality of bristles 112 may include a plurality of straight bristles, wherein the plurality of straight bristles may be arranged in one or more rows as illustrated in FIG. 4. In another embodiments, without limitation, plurality of bristles 112 may include a plurality of angled bristles, wherein the plurality of angled bristles may be slightly titled or slanted. In such embodiment, plurality of angled bristles may be configured to help grip user's hair better. In a further embodiments, without limitation, plurality of bristles 112 may include a plurality of circular bristles, wherein the plurality of circular bristles may be arranged in a spiral or circular pattern; for instance, plurality of circular bristles may create a ball-like shape. In such embodiment, plurality of circular bristles may be used in round barrel as described above. In other embodiments, and without limitation, plurality of bristles 112 may include a plurality of wavy bristles, wherein the plurality of wavy bristles may include a slightly curved shape configured to add volume and texture to user's hair. Further, plurality of bristles 112 may include mixed bristles which are made up of a combination of bristle shapes as listed above.

With continued reference to FIG. 1, brush head 104 of hair brushing device 100 includes at least a moisture-wicking component 116. As used in this disclosure, a "moisture-wicking component" is a component configured to absorb moisture. In a non-limiting example, at least a moisture-wicking component 116 is configured to absorb at least a fluid from the user's hair. At least a fluid may include, without limitation, sweat, water, and the like. In a non-limiting example, and still referring to FIG. 1, at least a moisture-wicking component 116 may include an absorbent cushion 120 attached to the at least a moisture-wicking component 116. As used in this disclosure, an "absorbent cushion" is a specialized material used in at least a moisture-wicking component 116 configured to provide absorbency. In some embodiments, absorbent cushion 120 may additionally provide comfort to the user using hair brushing device 100. In some embodiments, absorbent cushion 120 may be constructed from an absorbent material such as, without limitation, sponge, foam, microfiber, chamois, viscose, polyester material, and/or the like.

With continued reference to FIG. 1, in some case, absorbent cushion 120 may be treated with various coating (i.e., chemical finishes) configured to enhance the absorbency. In a non-limiting embodiment, absorbent cushion 120 may include a hydrophilic coating applied to the surface of absorbent cushion 120 to attract and absorb at least a fluid, wherein the hydrophilic coating may be used to repel moisture and keep absorbent cushion 120 dry. In another non-limiting embodiment, absorbent cushion 120 may include an antibacterial coating, wherein the antibacterial coating may prevent growth of bacterial and other microorganisms on absorbent cushion 120, thereby reducing the risk of infection or odor. In a further non-limiting embodiment, absorbent cushion 120 may include a phase change material (PCM) coating, wherein the PCM coating may regulate temperature of absorbent cushion 120, absorbing and/or releasing heat as needed. In other non-limiting embodiments, absorbent cushion 120 may include a fragrance coating, wherein the fragrance coating (i.e., essential oil, fragrance microcapsule, and the like) may provide a pleasant scent to absorbent cushion 120, thereby improving the user's experience.

With continued reference to FIG. 1, in some embodiments, at least a moisture-wicking component 116 may include one or more alignment features. As used in this disclosure, an "alignment feature" is a specialized structural element configured to position, hold, or otherwise attach absorbent cushion 120 at a specific area of moisture-wicking component. In some embodiments, alignment features may be used to secure absorbent cushion 120 in a specific location of the surface of at least a moisture-wicking component 116 and prevent absorbent cushion 120 from shifting or moving within brush head 104 during use of hair brushing device 100. In a non-limiting example, at least a moisture-wicking component 116 may include a grooved alignment feature, wherein the grooved alignment feature may include one or more grooves that are cut or molded into the surface of moisture-wicking component configured to hold absorbent cushion 120 at a specific region and provide additional cushioning and support for absorbent cushion 120. In another non-limiting example, at least a moisture-wicking component 116 may include a padded channels, wherein the padded channel is a channel or pocket integrated into at least a moisture-wicking component 116 configured to hold absorbent cushion 120. In a further non-limiting example, at least a moisture-wicking component 116 may include one or more inclined surfaces configured to position one or more portions of absorbent cushion 120 at different angles.

Still referring to FIG. 1, in some embodiments, without limitation, absorbent cushion 120 may be attached to at least a moisture-wicking component 116 via an adhesive; for instance, and without limitation, a double side adhesive (DSA) may be applied to alignment feature or absorbent cushion 120, wherein alignment feature and absorbent cushion may be pressed together to create a secure bond. In some embodiments, without limitation, absorbent cushion 120 may be attached to at least a moisture-wicking component 116 via an interlocking tab, wherein the interlocking tab may be configured to fit into corresponding slots on at least a moisture-wicking component 116; for instance, and without limitation, an interlocking tab may be disposed in each corner of absorbent cushion 120. Each interlocking tab may fit into a corresponding slot located at the surface of at least a moisture-wicking component 116. In some cases, interlocking tab may include a magnetic interlocking tab, wherein the magnetic interlocking tab may include a first magnet with a north/south pole facing towards a slot with a second magnet with a south/north pole facing towards magnetic interlocking tab. Such magnetic interlocking tab may be attracted to slot with second magnet, thereby attaching absorbent cushion 120 to at least a moisture-wicking component 116. In some embodiments, without limitation, absorbent cushion 120 may be attached to at least a moisture-wicking component 116 via a Velcro; for instance, and without limitation, absorbent cushion may include one or more Velcro strip that attached to at least a moisture-wicking component 116. In some embodiments, without limitation, absorbent cushion 120 may be attached to at least a moisture-wicking component 116 via compression fit; for instance, and without limitation, absorbent cushion 120 may fit tightly into grooves of alignment feature as described above, thereby creating a compression fit that holds absorbent cushion 120 in place. Persons skilled in the art will be aware, after reviewing the entirety of this disclosure, of different ways of attaching absorbent cushion 120 to at least a moisture-wicking component 116 that may be used hair brushing device 100 as described herein.

Additionally, or alternatively, and further referring to FIG. 1, at least a moisture-wicking component 116 may include a detach mechanism. As used in this disclosure, a "detach mechanism" is a device or mechanism that allows for an easy detachment or removal of absorbent cushion 120 from at least a moisture-wicking component 116. In some cases, attachment of absorbent cushion 120 listed above may include detach mechanism. In other cases, detach mechanism may be integrated into alignment features. In a non-limiting example, absorbent cushion 120 may be attached to at least a moisture-wicking component 116 through one or more clips disposed on the surface of at least a moisture-wicking component 116, wherein one or more clips may still allow for easy detachment or removal of absorbent cushion 120.

With continued reference to FIG. 1, further, at least a moisture-wicking component 116 may include a release mechanism. As used in this disclosure, a "release mechanism" is a device or mechanism that allows for the controlled release of moisture (i.e., at least a fluid) absorbed by absorbent cushion 120. In some embodiments, at least a moisture-wicking component 116 may be configured to transport at least a fluid absorbed away from a surface directly contacted with brush head 104 (i.e., absorbent cushion 120) to keep the surface dry. In some cases, release mechanism may be designed to provide controlled release of moisture to ensure that at least a moisture-wicking component 116 does not become overwhelmed and may be able to effectively manage at least a fluid absorbed. In other cases, transporting at least a fluid may include transporting at least a fluid to one or more components within hair brushing device 100 such as, without limitation, a sensor interface as described below in this disclosure. In a non-limiting example, moisture-wicking component 116 may include a perforated membrane placed within absorbent cushion 120, wherein the porous material may allow for the transfer of at least a fluid from absorbent cushion 120 to at least a moisture-wicking component 116. In such embodiment, perforated membrane may be configured to create a capillary action, wherein the "capillary action," for the purpose of this disclosure, is a phenomenon that occurs when at least a fluid absorbed in contact with a solid surface such as, without limitation, perforated membrane, and is able to move against gravity due to the combined effects of adhesive and cohesive forces.

With continued reference to FIG. 1, in some embodiments, barrel 108 may include at least a wicking window 124. As used in this disclosure, a "wicking window" is an aperture of barrel 108 configured to allow passage of at least a fluid from user's hair to the interior of the hair brushing device 100. In some embodiments, at least a wicking window 124 may be located at barrel 108 of brush head 104 behind plurality of bristles 112. In such embodiment, at least a wicking window 124 may be able to easily access user's hair. In some cases, at least a wicking window 124 may include various shapes such as, without limitation, circular, oval, rectangular, or any other shape that allows for the passage of at least a fluid. In a non-limiting example, barrel 108 may include a single wicking window 124 configured to expose a surface of moisture-wicking component 116, more specifically, absorbent cushion 120. In another non-limiting example, barrel 108 may include a plurality of wicking windows, wherein each wicking window of the plurality of wicking windows may be configured to expose at least a portion the surface of moisture-wicking component 116, more specifically, at least a portion of absorbent cushion 120.

Additionally, or alternatively, and still referring to FIG. 1, at least a wicking window 124 may include a closing mechanism. As described herein, a "closing mechanism" is a device or mechanism configured to close or seal the opening of at least a wicking window 124. In some embodiments, user may be able to partially/completely close at least a wicking window 124. In a non-limiting example, at least a wicking window 124 may include a sliding cover. User may move back sliding cover back and forth to open or close at least a wicking window 124. In another non-limiting example, at least a wicking window 124 may include a rotating disc. User may turn rotating disc to open or close at least a wicking window 124.

With continued reference to FIG. 1, in some embodiments, barrel 108 may include a barrel opening 128 disposed to at least a surface of barrel 108. As used in this disclosure, a "barrel opening" is a removable or adjustable portion of the surface of barrel 108 configured to enable access to at least a moisture-wicking component 116. In a non-limiting example, barrel opening 128 may include a removable section of barrel 108, wherein the removable section may be detached from the rest of barrel 108 for easy access to at least a moisture-wicking component 116. Removable section may be held in place by various means, such as, without limitation, clips, screws, magnets, and/or the like. In some embodiments, barrel opening 128 may be connected to a hinge 132. A "hinge," for the purpose of this disclosure, is a device configured to connect two parts (i.e., barrel opening 128 and barrel 108) allowing one part to swing or rotate relative to the other. In some cases, hinge 132 may include, without limitation, pin hinge, barrel hinge, snap hinge, and the like. In a non-limiting example, barrel 108 may include an aperture located at one side of barrel 108, wherein the aperture may be covered or closed by barrel opening 128. Hinge 132 may allow connected barrel opening 128 to be swung open. Such configuration may provide user access to at least a moisture-wicking component 116 disposed inside barrel 108 or other internal components of brush head 104 such as, without limitation, sensor device as described in further detail below. Accessing at least a moisture-wicking component 116 may include removing/installing at least a moisture-wicking component 116 from barrel 108. In other embodiments, Additionally, or alternatively, barrel opening 128 may be configured to facilitate maintenance and/or cleaning of at least a moisture-wicking component 116 and other internal components.

With continued reference to FIG. 1, in some embodiments, hair brushing device 100 includes at least a sensor device 136 configured to detect hair data pertaining to a user. A "sensor device," for the purposes of this disclosure, is an electronic device configured to detect, capture, measure, or combination thereof, a plurality of hair data. "Hair data," for the purpose of this disclosure, refers to various characteristics and parameters of user's hair in direct contact with brush head 104 of hair brushing device 100. In some embodiments, hair data may include a moisture level of user's hair. As used in this disclosure, a "moisture level" refers to an amount of moisture (i.e., at least a fluid) present in user's hair at a given time (e.g., when brush head 104 directly contact with user's hair). In some cases, moisture level may range from low (i.e., dry) to high (i.e., wet). In other cases, moisture level may scale from value x to y, wherein the value x may represent dry, and the value y may represent wet. Moisture level may be detected by moisture sensor as described below. In some embodiments, hair data may include temperature data of user's hair. As used in this disclosure, "temperature data" are data related to the degree of heat (in Fahrenheit/Celsius) present in user's hair at a given time. In a non-limiting example, temperature data may include temperature of skin of the user in Fahrenheit and/or Celsius. Temperature data may be detected by temperature sensor as described below. In other embodiments, hair data may further include, without limitation, hair type, hair length, hair thickness, hair density, and the like. Such hair data may be detected by optical device as described below.

With continued reference to FIG. 1, hair brushing device 100 a sensor interface 140. As used in this disclosure, a "sensor interface" is an arrangement that permits sensor device 136 to be in sensed communication with other components of hair brushing device 100. As used in this disclosure, "sensed communication" refers to a type of communication that is based on the detection and interpretation of physical signals from sensor device 136. In an embodiment, sensor interface 140 may be configured to provide a fluidic connection between at least a moisture-wicking component 116 and sensor device 136. As used in this disclosure, a "fluidic connection" is a connection allowing for the transfer of at least a fluid. Sensor device 136 may include a moisture sensor. As used in this disclosure, a "moisture sensor" is a device configured to detect the amount of moisture present in a material, such as, without limitation, user's hair. Moisture sensor may be configured to detect moisture level of user's hair. Sensor interface 140 may be contact with at least a surface of sensor device 136. Sensor interface 140 is configured to wet at least a surface of sensor device 136 with at least a fluid absorbed by at least a moisture-wicking component 116. In some cases, a surface of sensor device may be modified with hydrophilic chemistry, for instance by way of silanes, proteins, or another treatment (or may already be hydrophilic) in the sensing region. For example, and without limitation, sensor device 136 and sensor interfaces 140 may be configured such that at least a fluid wicks from at least a moisture-wicking component 116 from user's hair to the surface of sensor device as at least a fluid flows through sensor interface 140. Moisture sensor of sensor device 136 may then be configured to measure an amount of at least a fluid on sensor interface 140 and determine a moisture level as a function of the amount of at least a fluid.

With continued reference to FIG. 1, in a non-limiting embodiment, moisture sensor may include a capacitive moisture sensor, wherein the capacitive moisture sensor is a type of moisture sensor that works by measuring a capacitance of sensor interface 140 (i.e., the ability of sensor interface 140 to store an electrical charge). Capacitive moisture sensor may include two electrodes separated by a dielectric material such as air or a polymer. When dielectric material contains moisture, the capacitance of capacitive moisture sensor may change, as molecules of at least a fluid in the material increases effective area of electrodes. Sensor device 136 may determine moisture level by measuring the change in capacitance of capacitive moisture sensor. In a non-limiting example, two electrodes and may be located on each bristle of plurality of bristles 112 of hair brushing device 100. Sensor interface 140 may be located between two electrodes and at least a wicking component 116. As at least a wicking component 116 begin to absorb at least a fluid from user's hair, absorbed fluid may flow through sensor interface 140 which comes into contact with electrodes, capacitance of capacitive moisture sensor may change, and sensor device 136 may determine moisture level of the hair based on the change. Additionally, or alternatively, in another non-limiting embodiment, moisture sensor may include a resistance moisture sensor, wherein the resistance moisture sensor is a type of moisture sensor that works by measuring electrical resistance of sensor interface 140 (i.e., the ability of sensor interface 140 to resist the flow of electrical current) in a similar manner. In a non-limiting example, an electrical current may be passed through sensor interface 140, and the voltage drop across electrodes may be measured. Resistance may be calculated based on Ohm's law. Sensor device 136 may then determine moisture level as a function of the calculated resistance of sensor interface 140.

With continued reference to FIG. 1, in another embodiment, sensor interface 140 may be configured to provide a thermal connection between at least a moisture-wicking component 116 and sensor device 136. As used in this disclosure, a "thermal connection" is a connection allowing for transfer of heat. Sensor device 136 may include a temperature sensor. In a non-limiting example, sensor device 136 may include, without limitation, thermocouples, thermistors, thermometers, passive infrared sensors, resistance temperature sensors (RTD's), semiconductor based integrated circuits (IC), a combination thereof or another undisclosed sensor type, alone or in combination. "Temperature," for the purposes of this disclosure, and as would be appreciated by someone of ordinary skill in the art, is a measure of the heat energy of a system. Temperature, as measured by temperature sensor, may be measured in Fahrenheit (° F.), Celsius (° C.), Kelvin (° K), or another scale alone or in combination. In some embodiments, sensor device 136 may be configured to measure the temperature of sensor interface 140 (e.g., temperature of at least a fluid) using temperature sensor. In other embodiments, sensor device 136 containing temperature sensor disposed within plurality of bristles 112 may be configured to measure the temperature of user's hair directly when user's hair comes in contact with plurality of bristles 112. In other embodiments, temperature sensor may be further configured to measure the temperature of surrounding environment of the user.

With continued reference to FIG. 1, in a further embodiment, sensor device 136 may include an optical device. As used in this disclosure, an "optical device" is any device that generates, transmits, detects, or otherwise functions using electromagnetic radiation, including without limitation ultra-violet light, visible light, near infrared light, infrared light, and the like. In some embodiments, optical device may include one or more waveguide. As used in this disclosure, a "waveguide" is a component that is configured to propagate electromagnetic radiation, including without limitation ultra-violet light, visible light, near infrared light, infrared light, and the like. A waveguide may include a lightguide, a fiberoptic, or the like. A waveguide may include a grating within a transmissive material. In some cases, a waveguide may be configured to function as one or more optical devices, for example a resonator (e.g., microring resonator), an interferometer, or the like. In some cases, waveguide may be configured to propagate an electromagnetic radiation (EMR). In a non-limiting example, sensor device 136 may include a sensor, wherein the sensor may be optical communication with one or more waveguide. Such sensor may be configured to detect a variance in at least an optical property associated with the user's hair. As used in this disclosure, an "optical property" is any detectable characteristic associated with electromagnetic radiation, for instance UV, visible light, infrared, and the like. Sensor device 136 may be configured to hair data such as, without limitation, hair thickness, hair length, hair density, and the like as described above as a function of one or more optical properties.

With continued reference to FIG. 1, in some embodiments, sensor device 136 may include at least a photodetector. In some cases, sensor device 136 may include a plurality of photodetectors, for instance at least a first photodetector and at least a second photodetector. In some cases, at least a first photodetector and/or at least a second photodetector may be configured to measure one or more of first optical output and second optical output, from a first waveguide and a second waveguide, respectively. As used in this disclosure, a "photodetector" is any device that is sensitive to light and thereby able to detect light. In some cases, a photodetector may include a photodiode, a photoresistor, a photosensor, a photovoltaic chip, and the like. In some cases, photodetector may include a Germanium-based photodiode. Light detectors may include, without limitation, Avalanche Photodiodes (APDs), Single Photon Avalanche Diodes (SPADs), Silicon Photomultipliers (SiPMs), Photo-Multiplier Tubes (PMTs), Micro-Channel Plates (MCPs), Micro-Channel Plate Photomultiplier Tubes (MCP-PMTs), Indium gallium arsenide semiconductors (InGaAs), photodiodes, and/or photosensitive or photon-detecting circuit elements, semiconductors and/or transducers. Avalanche Photo Diodes (APDs), as used herein, are diodes (e.g., without limitation p-n, p-i-n, and others) reverse biased such that a single photon generated carrier can trigger a short, temporary "avalanche" of photocurrent on the order of milliamps or more caused by electrons being accelerated through a high field region of the diode and impact ionizing covalent bonds in the bulk material, these in turn triggering greater impact ionization of electron-hole pairs. APDs provide a built-in stage of gain through avalanche multiplication. When the reverse bias is less than the breakdown voltage, the gain of the APD is approximately linear. For silicon APDs this gain is on the order of 10-100. Material of APD may contribute to gains. Germanium APDs may detect infrared out to a wavelength of 1.7 micrometers. InGaAs may detect infrared out to a wavelength of 1.6 micrometers. Mercury Cadmium Telluride (HgCdTe) may detect infrared out to a wavelength of 14 micrometers. An APD reverse biased significantly above the breakdown voltage is referred to as a Single Photon Avalanche Diode, or SPAD. In this case the n-p electric field is sufficiently high to sustain an avalanche of current with a single photon, hence referred to as "Geiger mode." This avalanche current rises rapidly (sub-nanosecond), such that detection of the avalanche current can be used to approximate the arrival time of the incident photon. The SPAD may be pulled below breakdown voltage once triggered in order to reset or quench the avalanche current before another photon may be detected, as while the avalanche current is active carriers from additional photons may have a negligible effect on the current in the diode. At least a first photodetector may be configured to generate a first signal as a function of variance of an optical property of the first waveguide, where the first signal may include without limitation any voltage and/or current waveform. Additionally, or alternatively, sensor device may include a second photodetector located down beam from a second waveguide. In some embodiments, second photodetector may be configured to measure a variance of an optical property of second waveguide and generate a second signal as a function of the variance of the optical property of the second waveguide.

With continued reference to FIG. 1, in some cases, photodetector may include a photosensor array, for example without limitation a one-dimensional array. Photosensor array may be configured to detect a variance in an optical property of waveguide. In some cases, first photodetector and/or second photodetector may be wavelength dependent. For instance, and without limitation, first photodetector and/or second photodetector may have a narrow range of wavelengths to which each of first photodetector and second photodetector are sensitive. As a further non-limiting example, each of first photodetector and second photodetector may be preceded by wavelength-specific optical filters such as bandpass filters and/or filter sets, or the like; in any case, a splitter may divide output from optical matrix multiplier as described below and provide it to each of first photodetector and second photodetector. Alternatively, or additionally, one or more optical elements may divide output from waveguide prior to provision to each of first photodetector and second photodetector, such that each of first photodetector and second photodetector receives a distinct wavelength and/or set of wavelengths. For example, and without limitation, in some cases a wavelength demultiplexer may be disposed between waveguides and first photodetector and/or second photodetector; and the wavelength demultiplexer may be configured to separate one or more lights or light arrays dependent upon wavelength. As used in this disclosure, a "wavelength demultiplexer" is a device that is configured to separate two or more wavelengths of light from a shared optical path. In some cases, a wavelength demultiplexer may include at least a dichroic beam splitter. In some cases, a wavelength demultiplexer may include any of a hot mirror, a cold mirror, a short-pass filter, a long pass filter, a notch filter, and the like. An exemplary wavelength demultiplexer may include part No. WDM-11P from OZ Optics of Ottawa, Ontario, Canada. Further examples of demultiplexers may include, without limitation, gratings, prisms, and/or any other devices and/or components for separating light by wavelengths that may occur to persons skilled in the art upon reviewing the entirety of this disclosure. In some cases, at least a photodetector may be communicative with computing device (i.e., by means of sensed signal) as described below in this disclosure.

With continued reference to FIG. 1, hair brushing device 100 includes a brush handle 144. As used in this disclosure, a "brush handle" is a component configured to provide a means for the user to hold and manipulate brush head 104 during use. In a non-limiting example, brush handle 144 is attached to one end of brush head 104 configured to be held by the user. In some embodiments, brush handle 144 may be detachable; for instance, and without limitation, brush handle 144 may be attached to brush head 104 through a threaded connection, wherein the user may unscrew brush handle 144 from brush head 104. For another instance, and without limitation, brush handle 144 may be attached to brush head 104 through a snap-fit connection, wherein the user may apply pressure to a specific region to release the snap-fit connection, thereby detaching brush handle 144 from brush head 104. In some embodiments, brush handle 144 may include an ergonomic design configured to provide a comfortable grip (e.g., reduce hand fatigue during use). In a non-limiting example, brush handle 144 may include a contoured shape. Brush handle 144 may be shaped to fit the contours of user's hand. Brush handle 144 may include one or more curves and angles that provide a comfortable and secure grip. In some embodiments, brush handle 144 may include a non-slip texture configured to provide secure grip even when the user's hand is wet or slippery. In some embodiments, brush handle 144 may be attached to brush head 104 at a location on brush head 104, wherein brush handle 144 attached to such location may provide a neutral wrist position. "Neutral wrist position," as described herein, is a position in which the user's wrist is neutral or in a natural position. Such configuration may reduce the risk of injury or strain. In a non-limiting example, brush handle 144 may be angled to brush head 104. Additionally, or alternatively, brush handle 144 may include one or more finger grooves, wherein the finger grooves are indentations for the user's fingers to rest in. Finger grooves may provide additional security and avoid dropping hair brushing device 100.

With continued reference to FIG. 1, hair brushing device 100 may be powered by a power source. As used in this disclosure, a "power source" is any system, device, or means that provides power such as, without limitation, electric power to a device. Power source may provide electrical power to other devices and/or components within hair brushing device 100 such as, without limitation, sensor device 136, any computing device and/or the like. In a non-limiting example, brush handle 144 of hair brushing device 100 may be electrically connected to a power source. In some embodiments, power source may be externally electrically connected to hair brushing device 100. In such embodiment, power source may include an external power source such as, without limitation, a wall outlet. In some cases, transmitting electric power may include using one or more continuous conductor. A "continuous conductor," as described herein, is an electrical conductor, without any interruption, made from electrically conducting material that is capable of carrying electrical current. Electrically conductive material may comprise copper for example. Electrically conductive material may include any material that is conductive to electrical current and may include, as a nonlimiting example, various metals such as copper, steel, or aluminum, carbon conducting materials, or any other suitable conductive material.

With continued reference to FIG. 1, in some embodiments, power source may include a power regulator. As described in this disclosure, a "power regulator" is an electric device in power source that performs electrical power regulation or redistribution, wherein "power regulation" or "power redistribution," as described herein, refers to a process that keeps voltage of power source below its maximum value during operation, non-operation, or charging. In some embodiment, power source may include a balancer. As described herein, a "balancer" is an electric device in power source that performs power balancing, wherein "power balancing," for the purpose of this disclosure, refers to a process that balances electric energy from one or more first power sources (e.g., strong batteries) to one or more second power sources (e.g., weaker batteries).

With continued reference to FIG. 1, in some embodiments, power source may be incorporated by hair brushing device 100 internally. In a non-limiting example, brush handle 144 of hair brushing device may include a power source disposed inside hair brushing device 100 such as, without limitation, a battery 148. As used in this disclosure, a "battery" is an electrochemical device that stores and releases electrical energy by converting chemical energy into electrical energy through a chemical reaction. In some embodiments, battery 148 may be contained within brush handle 144 of hair brushing device 100. In some embodiments, battery may include one or more battery cells, wherein each battery cell may include a cathode, an anode, and an electrolyte configured to separate the cathode and the anode. Exemplary battery cells may include, without limitation, lithium-ion battery cells, lithium-metal battery cells, air-metal battery cells, lead-acid battery cells, or the like. In a non-limiting example, battery 148 may include a coin battery. As used in this disclosure, a "coin battery" is a button cell that is shaped as a squat cylinder resembling a button. Coin battery may include a bottom body in stainless steel as a positive terminal, and a metallic top cap as a negative terminal. In another non-limiting example, power source may include a lithium coin battery. In some embodiments, battery 148 may be removable or non-removable. In some embodiments, battery may be rechargeable or non-rechargeable. In a non-limiting example, battery 148 may be charged by external base unit during storage as described in further detail below.

With continued reference to FIG. 1, in some embodiments, brush handle 144 may include an indicator light 152 configured to provide feedback to the user about the status of hair brushing device 100 or the hair being brushed. In some cases, indicator light 152 may include any light-emitting electronic component, including without limitation a light-emitting diode (LED). In some embodiments, brush handle 144 may include a battery level indicator, wherein the battery level indicator may show a battery status (e.g., remaining battery level) of hair brushing device 100. Battery level indicator may allow the user to know when hair brushing device 100 needs to be charged; for instance, and without limitation, battery level indicator may change the light from green to yellow to red as battery level decreases. For another example, and without limitation, battery level indicator may emit light while the hair brushing device 100 is charging, and cease illumination when charging is complete. Battery level indicator may emit a first color of light while charging is occurring and a second color of light when charging is complete, may blink to indicate charging is currently occurring, or the like. Any suitable pattern of illumination in response to charging status of hair brushing device 100 may be used. Additionally, or alternatively, indicator light 152 may include a hair data indicator. "Hair data indicator," for the purpose of this disclosure, is an indicator light that shows hair data such as, without limitation, moisture level, temperature, and/or the like of the user's hair. In a non-limiting example, hair data indicator may change the intensity of the light from strong to medium to low as the moisture level and/or temperature decrease.

With continued reference to FIG. 1, hair brushing device 100 may include an external base unit. As used in this disclosure, an "external base unit" is a separate device that is configured to work in conjunction with hair brushing device. In some embodiments, external base unit may be configured to hold, stabilize, or otherwise support hair brushing device during storage. External base unit may be physically connected to hair brushing device 100. In some embodiments, external base unit may include a docking mechanism; for instance, and without limitation, external base unit may include a cradle or dock that is shaped to fit brush handle 144 securely. Cradle or dock may be angled or adjustable to provide a desired viewing angle for the user. In some embodiments, external base unit may be weighted. In such embodiment, weighted external base unit may provide stability and prevent hair brushing device 100 from tipping over. In some cases, weight may be distributed evenly within external base unit. In other cases, weight may be concentrated in one or more specific areas of external base unit such as, without limitation, one or more corners of external base unit.

With continued reference to FIG. 1, external base unit may be configured to charge battery of hair brushing device 100. External base unit may be electrically connected to hair brushing device 100. In some embodiments, external base unit may include a first charging port configured to connect with a second charging port on hair brushing device 100. Charging ports may use various charging technologies, such as, without limitation, USB/USBC, wireless charging, magnetic charging, and the like. In some embodiments, external base unit may include light indicator as described above to notify the user of the charging status of the hair brushing device 100; for instance, light color and/or pattern may be consistent with battery level indicator on brush handle 144 as described above. Such external base unit may be connected to external power source as described in further detail below, such as, without limitation, a wall outlet.

With continued reference to FIG. 1, external base unit may be further configured to sterilize absorbent cushion 120 and expedite a drying process of absorbent cushion 120. In some embodiments, external base unit may include a light source. As used in this disclosure, a "light source" is any device configured to emit electromagnetic radiation, such as without limitation light, UV, visible light, and/or infrared light. In some cases, a light source may include a coherent light source, which is configured to emit coherent light, for example a laser. In some cases, a light source may include a non-coherent light source configured to emit non-coherent light, for example a light emitting diode (LED). In some cases, light source may emit a light having substantially one wavelength. In some cases, light source may emit a light having a wavelength range. Light may have a wavelength in an ultraviolet range, a visible range, a near-infrared range, a mid-infrared range, and/or a far-infrared range. Light sources may include, one or more diode lasers, which may be fabricated, without limitation, as an element of an integrated circuit; diode lasers may include, without limitation, a Fabry Perot cavity laser, which may have multiple modes permitting outputting light of multiple wavelengths, a quantum dot and/or quantum well-based Fabry Perot cavity laser, an external cavity laser, a mode-locked laser such as a gain-absorber system, configured to output light of multiple wavelengths, a distributed feedback (DFB) laser, a distributed Bragg reflector (DBR) laser, an optical frequency comb, and/or a vertical cavity surface emitting laser. Light source may additionally or alternatively include a light-emitting diode (LED), an organic LED (OLED) and/or any other light emitter. In some cases, a light source may be configured to couple light into optical device of sensor device 136 as described above, for instance into one or more waveguides as described above. In a non-limiting example, external base unit may include an infrared light source configured to emit radiation within the IR range of the electromagnetic spectrum, which can penetrate deeply into absorbent cushion 120 and generate heat, thereby increasing the temperature of absorbent cushion 120 and speeding up the evaporation of moisture absorbed from user's hair during use. In another non-limiting example, external base unit may include a UV light source, wherein the UV light source may emit short-wavelength ultraviolet light that is effective in killing bacteria and other microorganisms that may accumulate on absorbent cushion 120 during use. In some cases, UV light source may also help expedite the drying process by breaking down organic matter and eliminating bacteria and other microorganisms that can contribute to moisture retention and odors. External base unit may be described in further detail below in reference to FIG. 2.

With continued reference to FIG. 1, in some cases, sensor device 136 may generate and/or communicate signal representative of the detected hair data. In an embodiment, sensor device 136 may be in communication with a computing device 156. In some embodiments, hair brushing device 100 may include a computing device 156. Computing device 156 may include any computing device as described in this disclosure, including without limitation a microcontroller, microprocessor, digital signal processor (DSP) and/or system on a chip (SoC) as described in this disclosure. Computing device may include, be included in, and/or communicate with a mobile device such as a mobile telephone or smartphone. Computing device 156 may include a single computing device operating independently, or may include two or more computing device operating in concert, in parallel, sequentially or the like; two or more computing devices may be included together in a single computing device or in two or more computing devices. Computing device 156 may interface or communicate with one or more additional devices as described below in further detail via a network interface device. Network interface device may be utilized for connecting computing device to one or more of a variety of networks, and one or more devices. Examples of a network interface device include, but are not limited to, a network interface card (e.g., a mobile network interface card, a LAN card), a modem, and any combination thereof. Examples of a network include, but are not limited to, a wide area network (e.g., the Internet, an enterprise network), a local area network (e.g., a network associated with an office, a building, a campus or other relatively small geographic space), a telephone network, a data network associated with a telephone/voice provider (e.g., a mobile communications provider data and/or voice network), a direct connection between two computing devices, and any combinations thereof. A network may employ a wired and/or a wireless mode of communication. In general, any network topology may be used. Information (e.g., data, software etc.) may be communicated to and/or from a computer and/or a computing device. Computing device 156 may include but is not limited to, for example, a computing device or cluster of computing devices in a first location and a second computing device or cluster of computing devices in a second location. Computing device 156 may include one or more computing devices dedicated to data storage, security, distribution of traffic for load balancing, and the like. Computing device may distribute one or more computing tasks as described below across a plurality of computing devices of computing device, which may operate in parallel, in series, redundantly, or in any other manner used for distribution of tasks or memory between computing devices. Computing device 156 may be implemented using a "shared nothing" architecture in which data is cached at the worker, in an embodiment, this may enable scalability of apparatus 100 and/or computing device 156.

With continued reference to FIG. 1, computing device 156 may be designed and/or configured to perform any method, method step, or sequence of method steps in any embodiment described in this disclosure, in any order and with any degree of repetition. For instance, computing device 156 may be configured to perform a single step or sequence repeatedly until a desired or commanded outcome is achieved; repetition of a step or a sequence of steps may be performed iteratively and/or recursively using outputs of previous repetitions as inputs to subsequent repetitions, aggregating inputs and/or outputs of repetitions to produce an aggregate result, reduction or decrement of one or more variables such as global variables, and/or division of a larger processing task into a set of iteratively addressed smaller processing tasks. Computing device 156 may perform any step or sequence of steps as described in this disclosure in parallel, such as simultaneously and/or substantially simultaneously performing a step two or more times using two or more parallel threads, processor cores, or the like; division of tasks between parallel threads and/or processes may be performed according to any protocol suitable for division of tasks between iterations. Persons skilled in the art, upon reviewing the entirety of this disclosure, will be aware of various ways in which steps, sequences of steps, processing tasks, and/or data may be subdivided, shared, or otherwise dealt with using iteration, recursion, and/or parallel processing.

With continued reference to FIG. 1, sensor device 136 may communicate with computing device 156 using one or more signals. As used in this disclosure, a "signal" is a human-intelligible and/or machine-readable representation of data, for example and without limitation an electrical and/or digital signal from one device to another; signals may be passed using any suitable communicative connection. A signal may include an optical signal, a hydraulic signal, a pneumatic signal, a mechanical signal, an electric signal, a digital signal, an analog signal, and the like. In some cases, a signal may be used to communicate with a computing device, for example by way of one or more ports. In some cases, a signal may be transmitted and/or received by computing device, for example by way of an input/output port. An analog signal may be digitized, for example by way of an analog to digital converter. In some cases, an analog signal may be processed, for example by way of any analog signal processing steps described in this disclosure, prior to digitization. In some cases, a digital signal may be used to communicate between two or more devices, including without limitation computing devices. In some cases, a digital signal may be communicated by way of one or more communication protocols, including without limitation internet protocol (IP), controller area network (CAN) protocols, serial communication protocols (e.g., universal asynchronous receiver-transmitter [UART]), parallel communication protocols (e.g., IEEE 128 [printer port]), and the like.

Still referring to FIG. 1, in some cases, hair brushing device 100, sensor device 136, and/or computing device 156 may perform one or more signal processing steps on a signal. For instance, hair brushing device 100, sensor device 136, and/or computing device 156 may analyze, modify, and/or synthesize a signal representative of data in order to improve the signal, for instance by improving transmission, storage efficiency, or signal to noise ratio. Exemplary methods of signal processing may include analog, continuous time, discrete, digital, nonlinear, and statistical. Analog signal processing may be performed on non-digitized or analog signals. Exemplary analog processes may include passive filters, active filters, additive mixers, integrators, delay lines, compandors, multipliers, voltage-controlled filters, voltage-controlled oscillators, phase-locked loops, and/or any other process using operational amplifiers or other analog circuit elements. Continuous-time signal processing may be used, in some cases, to process signals which vary continuously within a domain, for instance time. Exemplary non-limiting continuous time processes may include time domain processing, frequency domain processing (Fourier transform), and complex frequency domain processing. Discrete time signal processing may be used when a signal is sampled non-continuously or at discrete time intervals (i.e., quantized in time). Analog discrete-time signal processing may process a signal using the following exemplary circuits sample and hold circuits, analog time-division multiplexers, analog delay lines and analog feedback shift registers. Digital signal processing may be used to process digitized discrete-time sampled signals. Commonly, digital signal processing may be performed by a computing device or other specialized digital circuits, such as without limitation an application specific integrated circuit (ASIC), a field-programmable gate array (FPGA), or a specialized digital signal processor (DSP). Digital signal processing may be used to perform any combination of typical arithmetical operations, including fixed-point and floating-point, real-valued and complex-valued, multiplication and addition. Digital signal processing may additionally operate circular buffers and lookup tables. Further non-limiting examples of algorithms that may be performed according to digital signal processing techniques include fast Fourier transform (FFT), finite impulse response (FIR) filter, infinite impulse response (IIR) filter, and adaptive filters such as the Wiener and Kalman filters. Statistical signal processing may be used to process a signal as a random function (i.e., a stochastic process), utilizing statistical properties. For instance, in some embodiments, a signal may be modeled with a probability distribution indicating noise, which then may be used to reduce noise in a processed signal.

With continued reference to FIG. 1, computing device 156 of hair brushing device 100 may be configured to receive hair data from at least a sensor device 136. Hair data may include any hair data described in this disclosure. Computing device 156 may then transmit hair data to a hair drying device communicatively connected to hair brushing device 100. Hair drying device is described in further detail with reference to FIG. 3. As used in this disclosure, "communicatively connected" means connected by way of a connection, attachment, or linkage between two or more relata which allows for reception and/or transmittance of information therebetween. For example, and without limitation, this connection may be wired or wireless, direct, or indirect, and between two or more components, circuits, devices, systems, and the like, which allows for reception and/or transmittance of data and/or signal(s) therebetween. Data and/or signals therebetween may include, without limitation, electrical, electromagnetic, magnetic, video, audio, radio, and microwave data and/or signals, combinations thereof, and the like, among others. A communicative connection may be achieved, for example and without limitation, through wired or wireless electronic, digital, or analog, communication, either directly or by way of one or more intervening devices or components. Further, communicative connection may include electrically coupling or connecting at least an output of one device, component, or circuit to at least an input of another device, component, or circuit. For example, and without limitation, via a bus or other facility for intercommunication between elements of a computing device. Communicative connecting may also include indirect connections via, for example and without limitation, wireless connection, radio communication, low power wide area network, optical communication, magnetic, capacitive, or optical coupling, and the like. In some instances, the terminology "communicatively coupled" may be used in place of communicatively connected in this disclosure.

With continued reference to FIG. 1, computing device 156 may be further configured to adjust at least one hair drying parameter of hair drying device as a function of hair data. As used in this disclosure, "hair drying parameter" is a configuration of a setting or measurement that controls and/or monitors the drying process of user's hair using hair drying device as described below. Hair drying parameters may be communicated between hair brushing device 100 and hair drying device to coordinate operation of hair brushing device 100 and/or hair drying device. In an embodiment, hair drying parameter may include a temperature parameter, wherein the temperature parameter is a setting of the temperature of the flow generated by at least a fan via heating element (i.e., voltage or electrical current supplied to heating element) as described below. Adjusting hair drying parameter may include adjusting temperature parameter as a function of hair data. In a non-limiting example, hair drying device may process received hair data such as, without limitation, moisture level of user's hair detected by sensor device 136 and determine an optimal temperature for drying user's hair. In some cases, temperature parameter may be increased if the hair has a high moisture level to provide more heat and help dry the hair more quickly. In other cases, temperature parameter may be decreased if the hair has a low moisture level to avoid overheating and damaging the hair.

With continued reference to FIG. 1, in another embodiment, hair drying parameter may include a speed parameter, wherein the speed parameter is a setting of the velocity of the flow generated by at least a fan (i.e., spinning speed of plurality of blades of at least a fan) as described below. Adjusting hair drying parameter may include adjusting speed parameter as a function of hair data. In a non-limiting example, hair drying device may process received hair data such as, without limitation, hair thickness of user's hair detected by sensor device 136 and determine an optimal airflow velocity for drying the hair. In some cases, speed parameter may be increased it the hair is thick to provide more airflow and help dry the hair more quickly. In other cases, speed parameter may be decreased it the hair is thin to avoid excessive drying of the hair.

With continued reference to FIG. 1, in a further embodiment, hair drying parameter may include a duration parameter, wherein the duration parameter is a setting of the length of the hair drying process (i.e., using hair drying device). Adjusting hair drying parameter may include adjusting duration parameter as a function of hair data. In a non-limiting example, hair drying device may process received hair data such as, without limitation, hair texture (i.e., straight hair, wavy hair, curly hair, and the like) detected by sensor device 136 and determine an optimal length of the drying process. In some cases, drying process may be longer if the hair is curly (because the hair strands are more tightly coiled and tend to hold onto moisture). In other cases, drying process may be shorter if the hair is straight.

With continued reference to FIG. 1, specific algorithm may be used to adjust hair drying parameter of hair drying device based on hair data collected from hair brushing device 100. In some embodiments, computing device 156 may utilize a machine learning module to implement one or more algorithms or generate one or more machine-learning models to determine hair drying parameters as described above. However, the machine-learning module is exemplary and may not be necessary to generate one or more machine-learning models and perform any machine-learning described herein. In one or more embodiments, one or more machine-learning models may be generated using training data. Training data may include inputs and corresponding predetermined outputs so that a machine-learning model may use correlations between the provided exemplary inputs and outputs to develop an algorithm and/or relationship that then allows machine-learning model to determine its own outputs for inputs. Training data may contain correlations that a machine-learning process may use to model relationships between two or more categories of data elements. Exemplary inputs and outputs may come from a database or be provided by entity. Training data may include inputs from various types of databases, resources, and/or user inputs and outputs correlated to each of those inputs so that a machine-learning model may determine an output. Correlations may indicate causative and/or predictive links between data, which may be modeled as relationships, such as mathematical relationships, by machine-learning models. In one or more embodiments, training data may be formatted and/or organized by categories of data elements by, for example, associating data elements with one or more descriptors corresponding to categories of data elements. As a non-limiting example, training data may include data entered in standardized forms by persons or processes, such that entry of a given data element in a given field in a form may be mapped to one or more descriptors of categories. Elements in training data may be linked to descriptors of categories by tags, tokens, or other data elements.

Still referring to FIG. 1, machine-learning module may generate a hair drying machine-learning model, wherein generating the hair drying machine-learning model may include training hair drying machine-learning model by correlated inputs and outputs of training data. Training data may be data sets that have already been converted from raw data whether manually, by machine, or any other method. Training data may include previous outputs such that hair drying machine-learning model iteratively produces outputs. Hair drying machine-learning model may output converted data based on input of training data. In a non-limiting example, generating hair drying machine-learning model may include training hair drying machine-learning model using hair drying training data, wherein the hair drying training data may include a plurality of hair data correlated to a plurality of hair drying parameters. For example, hair drying training data may be used to show hair data may indicate one or more particular hair drying parameters. In some embodiment, hair drying training data may also include a plurality of hair data such as, without limitation, moisture levels, hair temperatures, hair textures, hair thickness, hair length, and/or the like, that are each correlated to one or more hair drying parameters such as, without limitation, temperature parameter, speed parameter, duration parameter, and/or the like. In such an embodiment, hair drying training data may be used to show how moisture level may indicate one or more hair drying parameter can be used during hair drying process. Computing device 156 may be configured to determine one or more hair drying parameters using trained hair drying machine-learning model as a function of received hair data.

Figure 2:
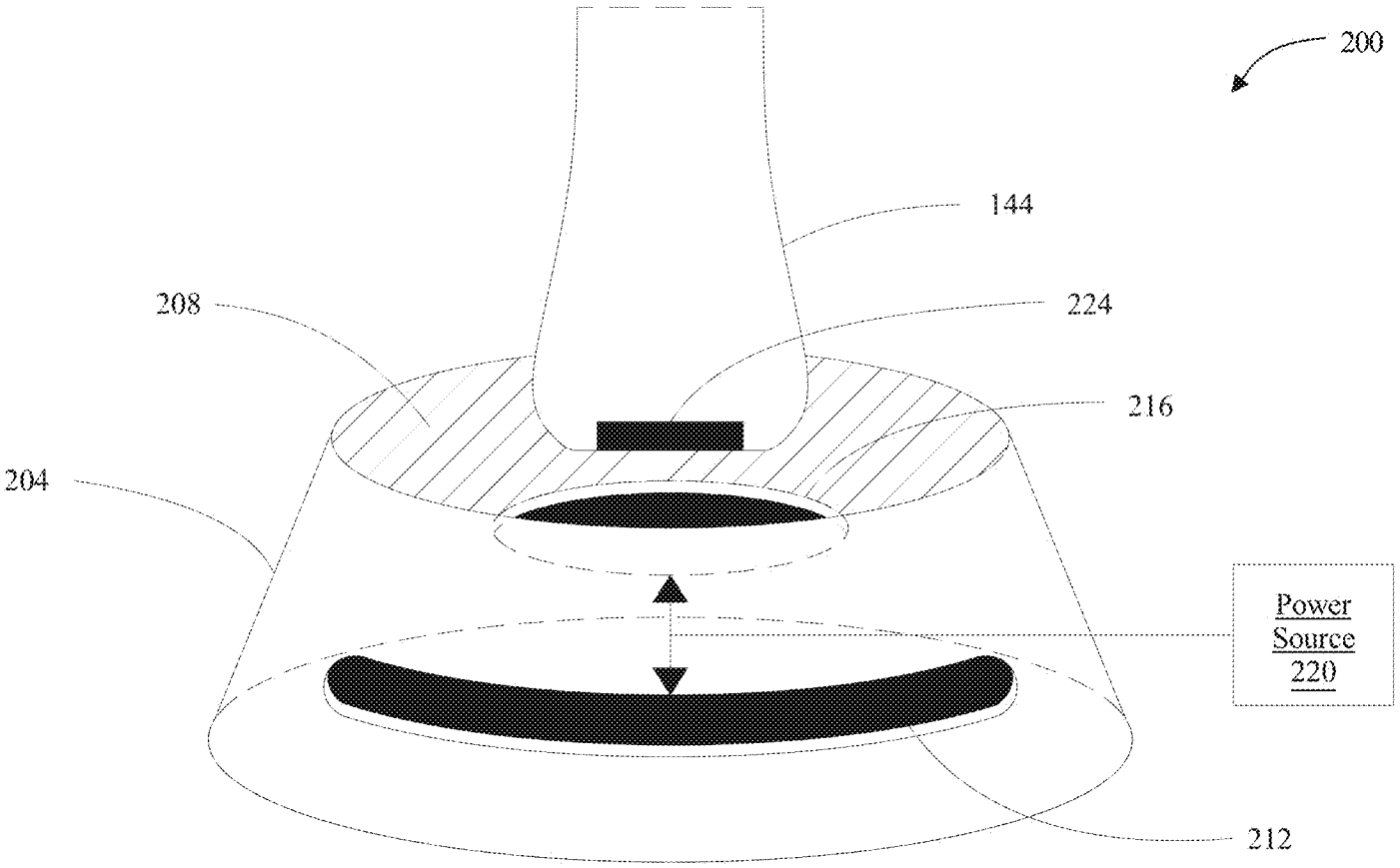
FIG. 2 is an exemplary embodiment of an external base unit.

Now referring to FIG. 2, an exemplary embodiment of an external base unit 200 is illustrated. External base unit 200 may include a base 204. As used in this disclosure, a "base" is a platform on which the hair brushing device 100 can be placed for support, charging, or other functions as described above in reference to FIG. 1. In some embodiment, base 204 may include a cradle or docking station that conforms to the shape of brush handle 144 as described above.

With continued reference to FIG. 2, base 204 may include a support surface 208. As used in this disclosure, a "support surface" is a surface on the base 204 which hair brushing device can rest or be secured. In an embodiment, support surface 208 may include a flat support surface, wherein the flat support surface is a smooth surface parallel to the ground without any significant bumps or irregularities. In such embodiment, flat support surface may accept at least a surface of brush head 104. In a non-limiting example, flat support surface may include one or more non-slip pads configured to provide additional stability and prevent the brush head 104 or hair brushing device 100 from sliding or shifting during use. Non-slip pads may be made from rubber or other material that provide a high coefficient of friction. In another non-limiting example, at least a surface of brush head 104 may be secured to flat support surface via magnetic attachment. Flat support surface may include a magnetic element that attracts and holds brush head 104 in place. In another embodiment, support surface 208 may include a contoured support surface. In such embodiment, contoured support surface may accept at least a portion of brush handle 144. In a non-limiting example, contoured support surface may include a custom molded shape. Contoured support surface may be custom-molded to fit the shape of at least a portion of brush handle 144.

With continued reference to FIG. 2, in some embodiments, external base unit 200 may include a light source 212. Light source 212 may include any light source as described above in this disclosure, such as, without limitation, UV/UV-C light, LED light, infrared light, fluorescent light, and any combination thereof. In some embodiments, light source 212 may emit electromagnetic radiation through a window located on at least a surface of base 204 of external base unit 200. Such window may include a transparent cover configured to protect light source from external factors while still allowing electromagnetic radiation to pass through. In a non-limiting example, user may detach absorbent cushion 120 from at least a moisture wicking component 116 and place absorbent cushion 120 in front of light source 212 within the range of the electromagnetic radiation. Light source 212 such as, without limitation, a UV/UV-C light may be configured to sterilize the absorbent cushion 120 as described above. Light source 212 may also be configured to expedite the drying process of the absorbent cushion 120 as described above.

With continued reference to FIG. 2, additionally, or alternatively, external base unit 200 may include a charging module 216 disposed on support surface 208. As used in this disclosure, a "charging module" is a component or device that provides electric power to device accepted by support surface 208 such as, without limitation, hair brushing device 100, to charge its batteries. Electric power may come from a power source 220. Power source 220 may be consistent with any power source as described in this disclosure. For example, power source 220 may include a battery and/or an electrical connection to an electrical outlet. In some embodiments, charging module 216 may include a connector that interface with an electrical contract 224 on brush handle 144 of hair brushing device 100. An "electrical contract," for the purpose of this disclosure, is a component that provides an electrical connection between two devices such as, without limitation, charging module 216 and hair brushing device 100. Electrical contract 224 may be used to transmit electrical signals, power, data, and/or the like. In a non-limiting example, electrical contract 224 may include a charging port disposed at the end of brush handle 144. Brush handle 144 may be accepted by contoured support surface and may be connected to charging module 216 via a connection of connector of charging module 216 and electrical contract 224. In other embodiments, charging module 216 may employ wireless charging technology to charge hair brushing device 100 without need for physical electrical contacts or connectors. In a non-limiting example, charging module 216 may include a charging coil that generates an electromagnetic field, while hair brushing device 100 may include a receiving coil that captures the energy from the electromagnetic field and use it to charge its batteries.

Additionally, or alternatively, with continued reference to FIG. 1, external base unit 200 may include a computing device. Computing device may include any computing device as described in this disclosure. Such computing device may be communicatively connected to computing device 156 of hair brushing device 100 as described above. Such computing device may be used to control and/or monitor other functions of external base unit 100 and/or hair brushing device 100 such as, without limitation, charging hair brushing device 100, sterilizing/drying absorbent cushion 120, and the like. Communication between external base unit 200 and hair brushing device may be achieved through various wireless communication protocols such as, without limitation, Wi-Fi, Bluetooth, NFC, and the like. Further, such computing device may be used to provide feedback and information to the user through various means; for instance, and without limitation, external base unit 200 may include indicator light as described above configured to display alerts to the user (e.g., when the battery is fully charged, absorbent cushion is fully sterilized, and the like). In some cases, alert may include audible alerts. For example, and without limitation, external base unit may further include a speaker integrated into base 204 configured to produce a variety of sounds such as tones, beeps, voice prompts, and the like.

Figure 3:
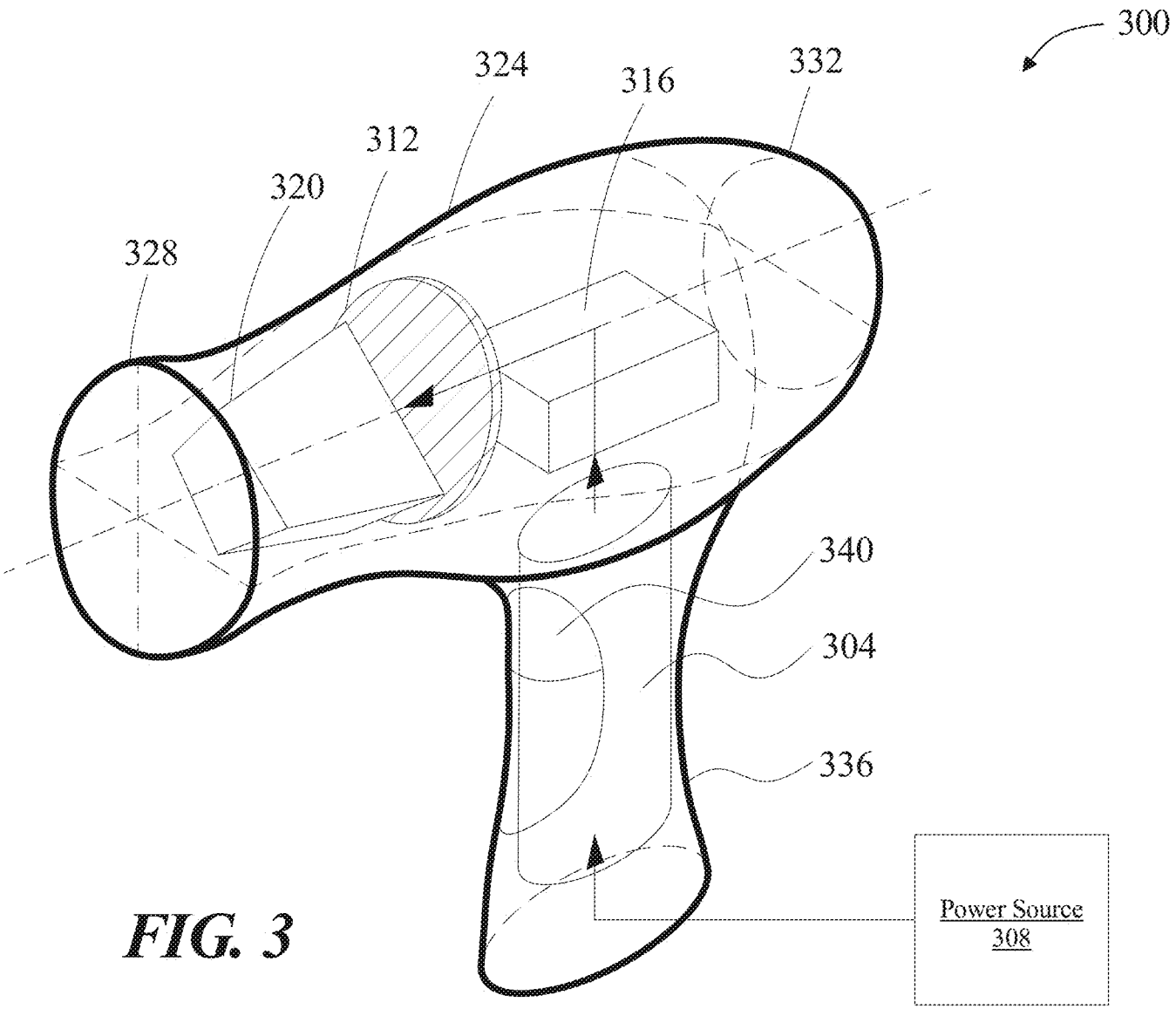
FIG. 3 is an exemplary embodiment of a hair drying device.

Now referring to FIG. 3, an exemplary embodiment of a hair drying device 300 is illustrated. As used in this disclosure, a "hair drying device" is a device configured to remove moisture (i.e., water) from the hair of a user through outputting airflow. In a non-limiting example, hair drying device 300 may be consistent with any hair drying device described in U.S. patent application Ser. No. 18/225,887, filed on Jul. 25, 2023, entitled "A HAIR DRYING DEVICE WITH NOISE REDUCTION ELEMENTS," the entirety of which is incorporated herein by reference.

With continued reference to FIG. 3, hair drying device 300 includes an electric motor 304 electrically connected to a power source 308. Power source 308 may include any power source as described in this disclosure. As used in this disclosure, an "electric motor" is a device that converts electrical energy into mechanical energy. In some embodiments, electric motor 304 may include a stator. A "stator", as used herein, is a stationary component of electric motor and/or electric motor assembly. In some embodiment, stator may include an inner and outer cylindrical surface; a plurality of magnetic poles may extend outward from the outer cylindrical surface of stator. In some cases, stator may include an annular stator, wherein the stator is ring-shaped.

With continued reference to FIG. 3, in some embodiments, electric motor 304 may include a rotor. For the purpose of this disclosure, a "rotor" is a portion of electric motor 304 that rotates with respect to stator of the electric motor. In a non-limiting example, electric motor may include a brushed DC motor. Stator may be incorporated into brushed DC motor where stator is fixed and functions to supply the magnetic fields where corresponding rotor rotates.

With continued reference to FIG. 3, as used in this disclosure, a "brushed DC motor" is an electric motor that operates using a mechanical communication system to control the current (i.e., direct current) flow to rotor. In some embodiments, brushed DC motor may additionally include a commutator, wherein the commutator is a cylindrical structure that is attached to rotor containing a series of metal segments that are insulated from each other. In some embodiments, brushed DC motor may further include one or more brushes, wherein the brushes are conductive contacts that are positioned on opposite sides of commutator, connected to a power source as described in further detail below.

In a non-limiting example, and still referring to FIG. 3, when an electric current is applied to stator of electric motor 304, stator may create a magnetic field that interacts with rotor of electric motor 304. Commutator and brushes may be used to switch the direction of the current flow to rotor as it rotates, causing rotor to generate mechanical energy. In some cases, the speed and torque of electric motor 304 may be controlled by adjusting the voltage or current supplied to stator. In other cases, the speed and torque of electric motor 304 may be controlled by changing the number of poles on stator or rotor.

With continued reference to FIG. 3, additionally, or alternatively, electric motor 304 may include an AC motor. As used in this disclosure, an "AC" motor stator is an electric motor that operates using an alternating current (AC) to generate magnetic field that interacts with rotor to produce mechanical energy. In an embodiment, stator may be incorporated in an AC motor where stator is fixed and functions to supply the magnetic fields by radio frequency electric currents through an electromagnet to a corresponding rotor rotates. Persons skilled in the art will be aware, after reviewing the entirety of this disclosure, of many different electric motor and components thereof may be incorporated in hair drying device 300 that is further explained herein.

Still referring to FIG. 3, electric motor 304 may include a shroud. As used in this disclosure, a "shroud" is an enclosing structure used to cover electric motor 304. In a non-limiting example, electric motor 304 may be enclosed by a protective cover (i.e., shroud) to protect electric motor 304 from damage or exposure to environmental factors such as, without limitation, dust, moisture, vibration, and/or the like. In some embodiments, shroud may be constructed from a sound dampening material, wherein the "sound dampening material," for the purpose of this disclosure, is a material that is used to reduce or eliminate transmission of sound waves from one environment such as, without limitation, electrical motor 304 operation environment within hair drying device 300 to another environment such as, without limitation, surrounding environment of the user. In a non-limiting example, sound dampening material may include a variety of substance, including, without limitation, foam, rubber, fiberglass, composite material, any combination thereof and/or the like. Shroud constructed from sound dampening material may be aerodynamically shaped so that air flow obstruction is minimized; for instance, and without limitation, shroud may include a smooth surface and an oval or teardrop shape.

With further reference to FIG. 3, hair drying device 300 a cooling mechanism configured to cool electric motor 304. In some embodiments, cooling mechanism may include a heat pipe cooling system. As used in this disclosure, a "heat pipe cooling system" is a system that utilize one or more heat pipes to transfer heat away from electric motor 304 and dissipate transferred heat into surrounding environment, wherein the heat pipe is a passive heat transfer device that uses a sealed, evacuated tube filled with a working fluid to transfer heat from one location to another. In a non-limiting example, heat pipe cooling system may include one or more heat pipes that are mounted within shroud of electric motor 304 and in contact with the windings of electric motor or other heat generating components such as, without limitation, heating element as described below in this disclosure. As electric motor operates, heat may be generated within the windings, wherein such heat may be transferred to one or more heat pipes via conduction. Such heat dissipation of heat pipe cooling system may be used to regulate the temperature of electric motor 304 and/or other heat generating components.

Still referring to FIG. 3, additionally, or alternatively, cooling mechanism of hair drying device 300 may further include a venturi-based cooling system. As used in this disclosure, a "venturi-based cooling system" is a system that utilizes a venturi effect to create a pressure differential that drives a flow (i.e., air flow) through a cooling device. In a non-limiting example, cooling device may include a series of fins or other heat dissipating structures that are exposed to the flow to transfer heat away from electric motor 304 and/or other heat generating components. A "venturi effect," is a phenomenon that occurs when a fluid (i.e., air) flows through a constricted area of a pipe or channel resulting in a decrease in pressure, thereby increasing the velocity of airflow. In a non-limiting example, hair drying device 300 with venturi-based cooling system may force air through a narrow channel which creates a pressure differential that drives the air with increased velocity through cooling device. Persons skilled in the art will be aware, after reviewing the entirety of this disclosure, of different cooling mechanism may be integrated within hair drying device 300 configured to dissipate heat explained herein.

With continued reference to FIG. 3, hair drying device 300 includes at least a fan 312. At least a fan 312 may include a plurality of blades. As used in this disclosure, a "fan" is a device that moves air by means of rotating plurality of blades or vanes to generate a flow (i.e., a stream of air). Flow may be directed towards a user's hair. In some embodiments, electric motor 304 of hair drying device 300 may include a shaft, wherein the "shaft," as described in this disclosure, is a rotating component that transmits torque or force between other components. Shaft may include a circular cross-section and may be configured to rotate within bearings of other support structures. In a non-limiting example, shaft may be driven by electric motor 304 powered by power source 308, and may transmit power to other components such as, without limitation, at least a fan 312. At least a fan 312 may include a hub, wherein the "hub" is a central component configured to provide a mounting point for other components such as, without limitation, shaft of electric motor 304. In some embodiments, hub may be stationary or rotate along with the connected shaft. In a non-limiting example, plurality of blades may be around hub. In some cases, plurality of blades may be oriented in a spiral or radial configuration to optimize the flow. At least a fan 312 may rotate as shaft of electric motor rotates, wherein the rotation of at least a fan 312 may draw air from surrounding environment and accelerates the air through rotating plurality of blades, thereby generating a flow.

With continued reference to FIG. 3, hair drying device 300 may include a gear 316, wherein the gear may include a plurality of teeth. As used in this disclosure, a "gear" is a mechanical component that transmits torque or force between rotating components by means of meshing plurality of teeth. In some embodiments, gear 316 may be configured to change the direction of mechanical energy produced by electric motor 304. In a non-limiting example, in some instances, the hair drying device 300 may include a right-angle drive. Gear 316 may include a first gear (i.e., input gear) and a second gear (i.e., output gear), wherein the first gear may be mechanically fixed to one end of a first shaft where another end attached to electric motor 304, and the second gear may be mechanically fixed to one end of a second shaft with at least a fan 312 attached. First gear may rotate in a clockwise direction, plurality of teeth of first gear may push against plurality of teeth of meshed second gear, wherein second gear may be oriented perpendicular to the first gear. In such embodiment, second gear may rotate in a counterclockwise direction. Gear 316 may be used to transmit torque or force between rotating components that are oriented in different directions, allowing mechanical energy to be transferred and redirected as needed by system 300. Additionally, or alternatively, gear 316 may include a magnetic gear. As used in this disclosure, a "magnetic gear" is a type of gear that uses magnetic fields to transmit torque between two rotating components. In some embodiment, the magnetic gears do not contact each other, and thus generate very little sound during operation. In a non-limiting example, magnetic gear may include circular gears with a plurality of magnetic pads oriented about an angled surface along the circumference of each gear. In some cases, gear 316 may be shrouded to further reduce noise.

With continued reference to FIG. 3, in some embodiments, hair drying device 300 may include a dual-fan system. As used in this disclosure, a "dual-fan system" is a mechanical system that uses at least two fans to generate fluid flow such as, without limitation, airflow. Dual-fan system may include two or more fans that are arranged in a specific configuration to achieve a desired performance objective of hair drying device 300. In a non-limiting example, at least a fan 312 of hair drying device 300 may include a first fan (i.e., fore blade) and a second fan (i.e., aft blade), wherein both fans may be identical from at least a fan 312 as described above. In some cases, first fan and second fan may be disposed on either side of electric motor 304 of hair dryer device 304. In some embodiments, first fan and second fan may be arranged in a sequence on shaft of electric motor 304 at a distance. In such embodiment, dual-fan system may result in at least two fans being run at a lower revolution per minute (RPM) instead of a conventional RPM (e.g., 15,000 RPM); therefore, aids with noise reduction. Additionally, or alternatively, gear 316 may be used to operate at least two fans of dual-fan system; for instance, and without limitation, at least two fans may attach to a same shaft connected to gear 316. In other cases, at least two fans of dual-fan system may operate separately; for instance, and without limitation, gear 316 may include a second gear connected to a separate shaft with second fan attached. Electric motor 304 may be sandwiched between at least two fans. Further, plurality of blades of at least two fans may rotate bidirectionally (i.e., in different directions). In such embodiment, dual-fan system may aid with generating a more direct (i.e. straight) flow path.

With continued reference to FIG. 3, hair drying device 300 includes at least a heating element 320 powered by power source 308. As used in this disclosure, a "heating element" is a component that is configured to generate heat. In some embodiments, heating element 320 may include a wire coil, wherein the wire coil may be wrapped around a ceramic or other heating-resistant material such as, without limitation, metal alloys (e.g., nichrome, kanthal, and the like) and/or composite materials that are designed to withstand high temperatures and provide consistent heating performance over time. In a non-limiting example, electrical current transmitted from power source 308 may pass through wire coil of heating element 320, thereby generating heat, wherein the heat may be transferred to the surrounding air or other medium. In other embodiments, heating element 320 may include a ceramic plate or other flat surface that is heated by electrical current. In such embodiment, heated flat surface may be used to direct heated air within hair drying device 300.

With continued reference to FIG. 3, additionally, or alternatively, heating element 320 of hair drying device 300 may be shaped to reduce noise while still allowing for effective transference of heat to the flow generated by at least a fan 312 driven by electric motor 304. In some embodiments, heating element 320 may include a plurality of fins. As used in this disclosure, "fins" are thin, protruding structures attached to the surface of heating element 320 configured to increase the surface area of heating element 320. Plurality of fins may be configured to improve heat transfer efficiency. In a non-limiting example, plurality of fins may be attached to surface of heating element 320 in order to increase the amount of heat that is transferred to the surrounding air.

Still referring to FIG. 3, in some embodiments, plurality of fins may be arranged in a variety of patterns depending on desired heating performance. In a non-limiting example, plurality of fins may include straight fins, wherein under this pattern, plurality of fins may be arranged in a straight line along the length of heating element 320. In another non-limiting example, plurality of fins may include wavy fins, wherein under this pattern, plurality of fins may be arranged in a wavy or zigzag pattern along the length of heating element 320. In a further non-limiting example, plurality of fins may include pin fins, wherein under this pattern, plurality of fins may be arranged in a series of small pins or needles along the surface of heating element 320. In other non-limiting example, plurality of fins may include helical fins, wherein under this pattern, plurality of fins may be arranged in a helix or spiral pattern along the length of heating element 320. Persons skilled in the art will be aware, after reviewing the entirety of this disclosure, of many different fins arrangement patterns for heating element 320 may be incorporated in hair drying device 300 that is further explained herein.

With further reference to FIG. 3, plurality of fins may be constructed from materials with a high thermal conductivity (e.g., metal alloy, ceramic, and the like as described above). Additionally, or alternatively, plurality of fins may include various geometries and/or orientations. For instance, and without limitation, each fin of plurality of fins may have a smooth surface. In other instances, and without limitation, each fin of plurality of fins may have a textured surface (e.g., ridges or dimples) to further increase a surface area of the heating element 320. Further, plurality of fins may be oriented radially about the interior of a nozzle of the hair drying device, where the length of each fin of plurality of fins may extend parallel to a central axis of the nozzle. Nozzle disclosed here is described in further detail below. Such configuration of plurality of fins of heating element 320 may also aid in noise reduction as described above. In other embodiments, plurality of fins may be planar or triangularly shaped to act like internal chevrons.

With continued reference to FIG. 3, hair drying device 300 includes a housing 324. As used in this disclosure, a "housing" is an external structure or casing that encloses internal components of hair drying device 300 such as, without limitation, electric motor 304, at least a fan 312, gear 316, heating element 320 and the like as described above in this disclosure. In some embodiments, housing 324 may include an inlet 328, an outlet 332, and a handle 336. As used in this disclosure, an "inlet" is an opening, or otherwise a passage of housing 324 of hair drying device 300 through which air can enter. In some embodiments, inlet 328 may be located at the rear of hair drying device 300, after handle 336. In some cases, inlet 328 may include a filter configured to filter out debris or other particles from air such as, without limitation, dust, hair, lint, and the like to prevent them from entering internal components (e.g., at least a fan 312) of hair drying device 300, wherein the filter may be placed over inlet 328. Filtering may be accomplished through the use of a mesh or other type of filter material such as, without limitation, activated carbon, polyester, fiberglass, and the like thereof. In some embodiments, the size and shape of inlet 328 may be designed to optimize the flow of air into hair drying device 300 and/or to minimize noise; for instance, and without limitation, inlet 328 may be shaped to create venturi effect as described above. Additionally, or alternatively, inlet 328 may be connected to a duct or other passage that directs air to internal components of hairy drying device 304. In a non-limiting example, inlet 328 may be connected with a duct containing at least a fan 312 and heating element 320.

Still referring to FIG. 3, an "outlet," on the other hand and for the purpose of this disclosure, is an opening, or otherwise a passage of housing 324 of hair drying device 300 through which air can exit. In some embodiments, outlet 332 may be located at the front of hair drying device 300, before handle 336. In a non-limiting example, outlet 332 may be shaped and positioned to direct flow generated by at least a fan 312 to a specific area of user's hair. Outlet 332 may be connected to a duct or other passage that directs air from internal components of hairy drying device 304 to outlet 332. In some embodiments, outlet 332 may include a diffuser attachment, wherein the diffuser attachment is a device used to disperse the flow generated by at least a fan 312 and output through outlet 332 over a wider area. In other embodiments, outlet 332 may include a concentrator attachment, wherein the concentrator attachment is a device used to focus flow generated by at least a fan 312 and output through outlet 332 onto a specific section of user's hair.

With further reference to FIG. 3, as used in this disclosure, a "handle" is a portion of housing 324 configured to be held by the user of hair drying device 300. Handle 336 may be located at the bottom of hair drying device 300. In some embodiments, handle 336 may be ergonomically designed to provide a comfortable and secure grip. In a non-limiting example, handle 336 may wrap about a hand of the user so that excessive force or energy may not be required by handle 336 of hair drying device 300. Such ergonomic design may reduce muscle strain on the user during operation of hair drying device 300. In another non-limiting example, handle 336 may wrap about the forearm or contact a dorsal area of the user's hand for additional support. In some instances, handle 336 may extend downward so that the body (i.e., inlet 328, connected duct, and outlet 332) of the hair drying device 300 may hang below handle 336 and the hand of the user. Additionally, or alternatively, handle 336 may include a fully integrated handle, wherein the fully integrated handle is a handle 336 that is seamlessly and permanently integrated into the body of hair drying device 300. In a non-limiting example, body of hair drying device 300 and fully integrated handle may be a monolithic component. Electric motor 304 may be disposed in handle 336. Further, handle 336 of hair drying device may include a detachable handle, wherein the detachable handle may be able to separate from body of hair drying device 300. In a non-limiting example, housing 324 may include a swivel joint, wherein the swivel joint may allow handle 336 to be pivoted relative to body of the hair drying device 300.

With continued reference to FIG. 3, in some embodiments, housing 324 may be constructed from an injectable mold. In a non-limiting example, housing 324 may be constructed from plastic material. As used in this disclosure, an "injectable mold" is a manufacturing tool for producing plastic parts such as, without limitation, housing 324 and elements thereof (i.e., inlet 328, outlet 332, and handle 336). Manufacturing housing 324 may include using an injection molding process, wherein the injection molding process may involve a use of injectable mold configured to create specific shape and features of housing 324. In some embodiments, injectable mold may include two halves that are clamped together, with one or more cavities in between, wherein the cavities may define the shape of housing 324. In some cases, material such as, without limitation, molten plastic may be injected into the injectable mold under high pressure, filling the space and taking on the shape of injectable mold. Injection molding process may include a cooling process which is configured to cool and/or solidify injected material. Injectable mold may be then opened and finished housing 324 may be removed. In some embodiments, injectable mold may be precisely machined to desired shape and size of housing 324. In a non-limiting example, housing 324 may include a bell-shaped inlet. Nozzle of housing 324 may include a plurality of chevrons, which may be arranged along a perimeter or disposed along an interior surface of outlet 332. Such configuration may reduce noise of the output airflow. Additionally, or alternatively, outlet 332 may include an adjustable geometry and/or include a choke.

With continued reference to FIG. 3, housing 324 may include an external mount. As used in this disclosure, an "external mount" is a component on housing 324 that allows wires or cables to be securely attached to hair drying device 300 externally. In a non-limiting example, housing 324 may include external mount such as, without limitation, cable channels, cable clips, cable ties, and the like that allows a wire of hair drying device 300 to be selectively attached to housing 324 at a more ergonomic location. Wire may be connected to external power source as described above in this disclosure. In such embodiment, external mount may prevent wire from undesirably counteracting/resisting movements of the user of hair drying device 300.

With continued reference to FIG. 3, hair drying device 300 may include a computing device. Computing device may include any computing device as described in this disclosure. In some embodiments, computing device of hair drying device 300 may be communicatively connected to computing device of hair brushing device 100 as described above. Computing devices may be connected through a network. In some cases, network may include any type of network architecture. For example, network may include a peer to peer (P2P) architecture where each computing device in a computing network is connected and every computing device may act as a server for the data stored in the computing device. However, the network architecture is not limited thereto. In some cases, any network topology may be used in the network. For example, network may employ a mesh topology where computing device of hair drying device 300 is connected to computing device of hair brushing device 100 using point to point connections. However, the network topology is not limited thereto. In some embodiments, computing devices may communicate with each other via a communication network. A communication network may include a network interface card (e.g., a mobile network interface card, a LAN card), a modem, and any combination thereof. A communication network may also include a wide area network (e.g., the Internet, an enterprise network), a local area network (e.g., a network associated with an office, a building, a campus, or other relatively small geographic space), a telephone network, a data network associated with a telephone/voice provider (e.g., a mobile communication provider data and/or voice network), a direct connection between two computing devices, and any combination thereof. A communication network may employ a wired and/or wireless mode of communication. Hair data and/or hair drying parameter may be communicated from computing device of hair brushing device 100 to computing device of hair drying device 300 through a communication network. Computing device may then adjust hair drying parameters of hair drying device 300 based on received data.

With continued reference to FIG. 3, hair drying device 300 may further include a display 340 communicatively connected to computing device of hair drying device 300. Display 340 may be disposed on handle 336 of hair drying device 300. As used in this disclosure, a "display" is a device configured to provide a visual feedback or information to the user of hair drying device 300. In a non-limiting example, display 340 may include indicator light as described above. In another non-limiting example, display 340 may include a digital screen. In an embodiment, display 340 may be used to present hair data received from hair brushing device 100 as described above. In a non-limiting example, display 340 may provide information about user's hair data, such as moisture level, hair thickness, hair temperature, hair texture, hair length, hair density, and the like. In another embodiment, display 340 may be used to present one or more hair drying parameters of hair drying device 300. In a non-limiting example, display 340 may provide information about various settings of hair brushing device such as, without limitation, temperature, speed, duration, and the like. Additionally, or alternatively, display 340 may allow the user to select or adjust hair drying parameters (i.e., settings) of hair drying device 300. In a non-limiting example, user may select power on/off hair drying device 300 via display 340. Further, display 340 may provide notifications or alerts to the user; for instance, and without limitation, when hair drying device needs to be cleaned or when a maintenance task needs to be performed on one or more internal components as described above.

Now referring to FIG. 4, an exemplary embodiment of a paddle hairbrush 400 of hair brushing device 100 is illustrated. Paddle hairbrush may include barrel 108 with a plurality of bristles 112. Barrel 108 may include a flat, wide brush barrel configured to be used on long or thick hair. Paddle hairbrush 400 may include at least a moisture-wicking component 116, wherein the at least a moisture-wicking component 116 may be in a long cylinder shape with absorbent cushion 120 wrapped around the surface of at least a moisture-wicking component 116. Plurality of bristles 112 may be arranged in a row. Barrel 108 may include a plurality of wicking windows 124. In some cases, plurality of wicking windows 124 may be disposed between plurality of bristles 112 configured to expose at least a portion of at least a moisture-wicking component 116. In a non-limiting example, a wicking window may be disposed between every bristle on barrel 108. Barrel 108 may include a barrel opening 128, wherein the barrel opening 128 may be located on one end of barrel 108 configured to enable access to at least a moisture-wicking component 116. Paddle hairbrush 400 may include a brush handle 144 attached to at least a surface of barrel 108. Sensor interface 140 may be placed within barrel 108 in contact with at least a surface of at least a moisture-wicking component 116 configured to wet at least a surface of sensor device 136. For instance, and without limitation, brush handle 144 may be attached to at barrel 108 at the center of the back surface of barrel 108. Sensor device 136 and computing device 156 may be disposed within brush handle 144.

Figure 5:
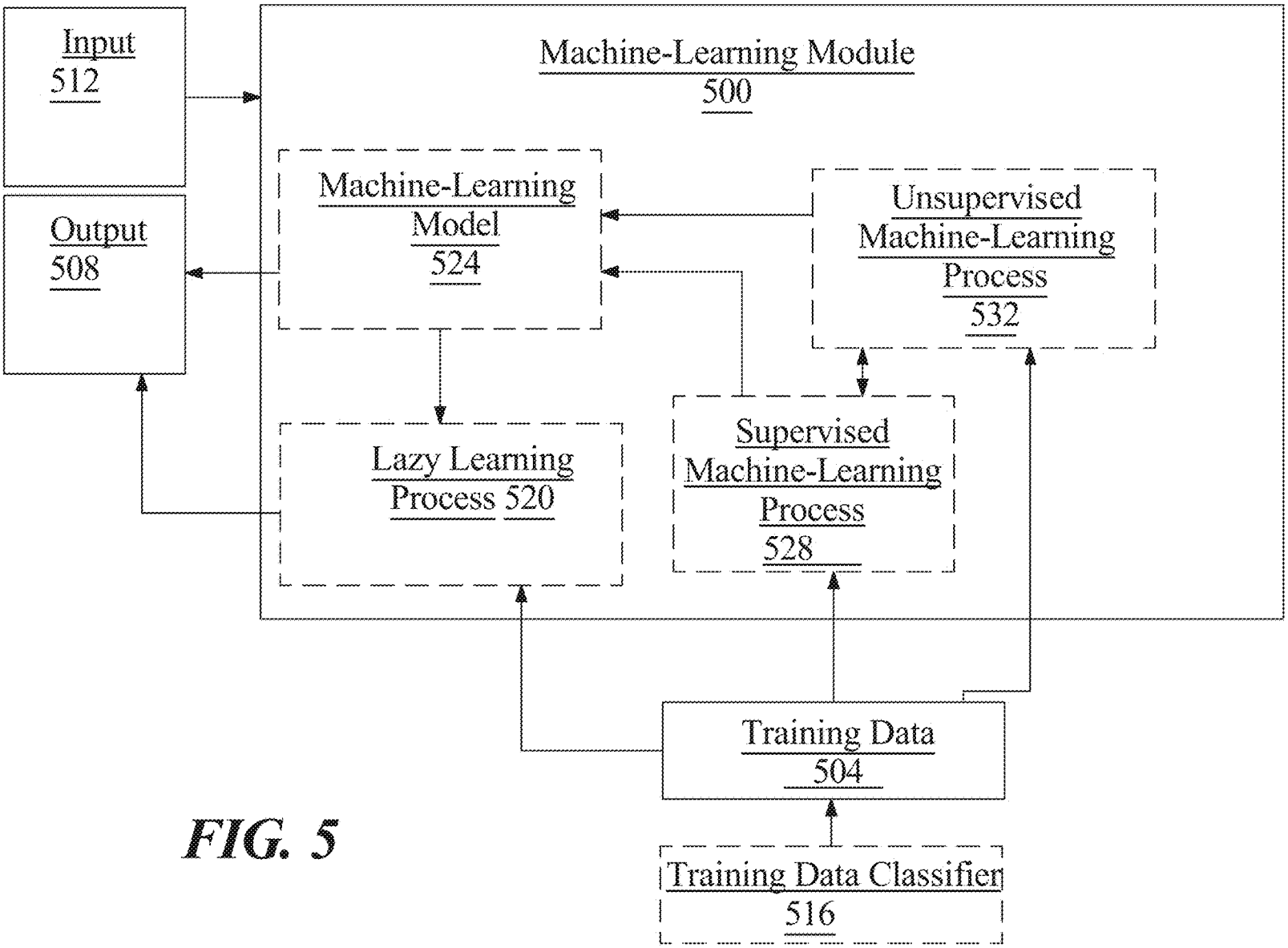
FIG. 5 is an exemplary embodiment of a machine-learning module.

Referring now to FIG. 5, an exemplary embodiment of a machine-learning module 500 that may perform one or more machine-learning processes as described in this disclosure is illustrated. Machine-learning module may perform determinations, classification, and/or analysis steps, methods, processes, or the like as described in this disclosure using machine learning processes. Machine-learning process may use training data 504 to generate an algorithm that will be performed by computing device/module to produce outputs 508 given data provided as inputs 512; this is in contrast to a non-machine learning software program where the commands to be executed are determined in advance by a user and written in a programming language. For instance, and without limitation, training data 504 may include a plurality of data entries, each entry representing a set of data elements that were recorded, received, and/or generated together; data elements may be correlated by shared existence in a given data entry, by proximity in a given data entry, or the like. Multiple data entries in training data 504 may evince one or more trends in correlations between categories of data elements; for instance, and without limitation, a higher value of a first data element belonging to a first category of data element may tend to correlate to a higher value of a second data element belonging to a second category of data element, indicating a possible proportional or other mathematical relationship linking values belonging to the two categories. Multiple categories of data elements may be related in training data 404 according to various correlations; correlations may indicate causative and/or predictive links between categories of data elements, which may be modeled as relationships such as mathematical relationships by machine-learning processes as described in further detail below. Training data 504 may be formatted and/or organized by categories of data elements, for instance by associating data elements with one or more descriptors corresponding to categories of data elements. As a non-limiting example, training data 404 may include data entered in standardized forms by persons or processes, such that entry of a given data element in a given field in a form may be mapped to one or more descriptors of categories. Elements in training data 404 may be linked to descriptors of categories by tags, tokens, or other data elements; for instance, and without limitation, training data 504 may be provided in fixed-length formats, formats linking positions of data to categories such as comma-separated value (CSV) formats and/or self-describing formats such as extensible markup language (XML), JavaScript Object Notation (JSON), or the like, enabling processes or devices to detect categories of data.

Alternatively or additionally, and continuing to refer to FIG. 5, training data 504 may include one or more elements that are not categorized; that is, training data 504 may not be formatted or contain descriptors for some elements of data. Machine-learning algorithms and/or other processes may sort training data 504 according to one or more categorizations using, for instance, natural language processing algorithms, tokenization, detection of correlated values in raw data and the like; categories may be generated using correlation and/or other processing algorithms. As a non-limiting example, in a corpus of text, phrases making up a number "n" of compound words, such as nouns modified by other nouns, may be identified according to a statistically significant prevalence of n-grams containing such words in a particular order; such an n-gram may be categorized as an element of language such as a "word" to be tracked similarly to single words, generating a new category as a result of statistical analysis. Similarly, in a data entry including some textual data, a person's name may be identified by reference to a list, dictionary, or other compendium of terms, permitting ad-hoc categorization by machine-learning algorithms, and/or automated association of data in the data entry with descriptors or into a given format. The ability to categorize data entries automatedly may enable the same training data 504 to be made applicable for two or more distinct machine-learning algorithms as described in further detail below. Training data 504 used by machine-learning module 500 may correlate any input data as described in this disclosure to any output data as described in this disclosure. As a non-limiting illustrative example, training data may include a plurality of hair data as input correlated to a plurality of hair drying parameters as output.

Further referring to FIG. 5, training data may be filtered, sorted, and/or selected using one or more supervised and/or unsupervised machine-learning processes and/or models as described in further detail below; such models may include without limitation a training data classifier 516. Training data classifier 516 may include a "classifier," which as used in this disclosure is a machine-learning model as defined below, such as a mathematical model, neural net, or program generated by a machine learning algorithm known as a "classification algorithm," as described in further detail below, that sorts inputs into categories or bins of data, outputting the categories or bins of data and/or labels associated therewith. A classifier may be configured to output at least a datum that labels or otherwise identifies a set of data that are clustered together, found to be close under a distance metric as described below, or the like. A distance metric may include any norm, such as, without limitation, a Pythagorean norm. Machine-learning module 500 may generate a classifier using a classification algorithm, defined as a processes whereby a computing device and/or any module and/or component operating thereon derives a classifier from training data 504. Classification may be performed using, without limitation, linear classifiers such as without limitation logistic regression and/or I Bayes classifiers, nearest neighbor classifiers such as k-nearest neighbors classifiers, support vector machines, least squares support vector machines, fisher's linear discriminant, quadratic classifiers, decision trees, boosted trees, random forest classifiers, learning vector quantization, and/or neural network-based classifiers.

Still referring to FIG. 5, machine-learning module 500 may be configured to perform a lazy-learning process 520 and/or protocol, which may alternatively be referred to as a "lazy loading" or "call-when-needed" process and/or protocol, may be a process whereby machine learning is conducted upon receipt of an input to be converted to an output, by combining the input and training set to derive the algorithm to be used to produce the output on demand. For instance, an initial set of simulations may be performed to cover an initial heuristic and/or "first guess" at an output and/or relationship. As a non-limiting example, an initial heuristic may include a ranking of associations between inputs and elements of training data 504. Heuristic may include selecting some number of highest-ranking associations and/or training data 504 elements. Lazy learning may implement any suitable lazy learning algorithm, including without limitation a K-nearest neighbors algorithm, a lazy naïve Bayes algorithm, or the like; persons skilled in the art, upon reviewing the entirety of this disclosure, will be aware of various lazy-learning algorithms that may be applied to generate outputs as described in this disclosure, including without limitation lazy learning applications of machine-learning algorithms as described in further detail below.

Alternatively or additionally, and with continued reference to FIG. 5, machine-learning processes as described in this disclosure may be used to generate machine-learning models 524. A "machine-learning model," as used in this disclosure, is a mathematical and/or algorithmic representation of a relationship between inputs and outputs, as generated using any machine-learning process including without limitation any process as described above, and stored in memory; an input is submitted to a machine-learning model 524 once created, which generates an output based on the relationship that was derived. For instance, and without limitation, a linear regression model, generated using a linear regression algorithm, may compute a linear combination of input data using coefficients derived during machine-learning processes to calculate an output datum. As a further non-limiting example, a machine-learning model 524 may be generated by creating an artificial neural network, such as a convolutional neural network comprising an input layer of nodes, one or more intermediate layers, and an output layer of nodes. Connections between nodes may be created via the process of training the network, in which elements from a training data 504 set are applied to the input nodes, a suitable training algorithm (such as Levenberg-Marquardt, conjugate gradient, simulated annealing, or other algorithms) is then used to adjust the connections and weights between nodes in adjacent layers of the neural network to produce the desired values at the output nodes. This process is sometimes referred to as deep learning.

Still referring to FIG. 5, machine-learning algorithms may include at least a supervised machine-learning process 528. At least a supervised machine-learning process 528, as defined herein, include algorithms that receive a training set relating a number of inputs to a number of outputs, and seek to find one or more mathematical relations relating inputs to outputs, where each of the one or more mathematical relations is optimal according to some criterion specified to the algorithm using some scoring function. For instance, a supervised learning algorithm may include hair data such as, without limitation, moisture level, hair temperature, hair thickness, hair texture, hair length, and the like as described above as inputs, hair drying parameter such as without limitation, temperature parameter, speed parameter, duration parameter, and the like as outputs, and a scoring function representing a desired form of relationship to be detected between inputs and outputs; scoring function may, for instance, seek to maximize the probability that a given input and/or combination of elements inputs is associated with a given output to minimize the probability that a given input is not associated with a given output. Scoring function may be expressed as a risk function representing an "expected loss" of an algorithm relating inputs to outputs, where loss is computed as an error function representing a degree to which a prediction generated by the relation is incorrect when compared to a given input-output pair provided in training data 504. Persons skilled in the art, upon reviewing the entirety of this disclosure, will be aware of various possible variations of at least a supervised machine-learning process 528 that may be used to determine relation between inputs and outputs. Supervised machine-learning processes may include classification algorithms as defined above.

Further referring to FIG. 5, machine learning processes may include at least an unsupervised machine-learning processes 532. An unsupervised machine-learning process, as used herein, is a process that derives inferences in datasets without regard to labels; as a result, an unsupervised machine-learning process may be free to discover any structure, relationship, and/or correlation provided in the data. Unsupervised processes may not require a response variable; unsupervised processes may be used to find interesting patterns and/or inferences between variables, to determine a degree of correlation between two or more variables, or the like.

Still referring to FIG. 5, machine-learning module 500 may be designed and configured to create a machine-learning model 524 using techniques for development of linear regression models. Linear regression models may include ordinary least squares regression, which aims to minimize the square of the difference between predicted outcomes and actual outcomes according to an appropriate norm for measuring such a difference (e.g. a vector-space distance norm); coefficients of the resulting linear equation may be modified to improve minimization. Linear regression models may include ridge regression methods, where the function to be minimized includes the least-squares function plus term multiplying the square of each coefficient by a scalar amount to penalize large coefficients. Linear regression models may include least absolute shrinkage and selection operator (LASSO) models, in which ridge regression is combined with multiplying the least-squares term by a factor of 1 divided by double the number of samples. Linear regression models may include a multi-task lasso model wherein the norm applied in the least-squares term of the lasso model is the Frobenius norm amounting to the square root of the sum of squares of all terms. Linear regression models may include the elastic net model, a multi-task elastic net model, a least angle regression model, a LARS lasso model, an orthogonal matching pursuit model, a Bayesian regression model, a logistic regression model, a stochastic gradient descent model, a perceptron model, a passive aggressive algorithm, a robustness regression model, a Huber regression model, or any other suitable model that may occur to persons skilled in the art upon reviewing the entirety of this disclosure. Linear regression models may be generalized in an embodiment to polynomial regression models, whereby a polynomial equation (e.g. a quadratic, cubic or higher-order equation) providing a best predicted output/actual output fit is sought; similar methods to those described above may be applied to minimize error functions, as will be apparent to persons skilled in the art upon reviewing the entirety of this disclosure.

Continuing to refer to FIG. 5, machine-learning algorithms may include, without limitation, linear discriminant analysis. Machine-learning algorithm may include quadratic discriminant analysis. Machine-learning algorithms may include kernel ridge regression. Machine-learning algorithms may include support vector machines, including without limitation support vector classification-based regression processes. Machine-learning algorithms may include stochastic gradient descent algorithms, including classification and regression algorithms based on stochastic gradient descent. Machine-learning algorithms may include nearest neighbors algorithms. Machine-learning algorithms may include various forms of latent space regularization such as variational regularization. Machine-learning algorithms may include Gaussian processes such as Gaussian Process Regression. Machine-learning algorithms may include cross-decomposition algorithms, including partial least squares and/or canonical correlation analysis. Machine-learning algorithms may include naïve Bayes methods. Machine-learning algorithms may include algorithms based on decision trees, such as decision tree classification or regression algorithms. Machine-learning algorithms may include ensemble methods such as bagging meta-estimator, forest of randomized trees, AdaBoost, gradient tree boosting, and/or voting classifier methods. Machine-learning algorithms may include neural net algorithms, including convolutional neural net processes.

Figure 6:
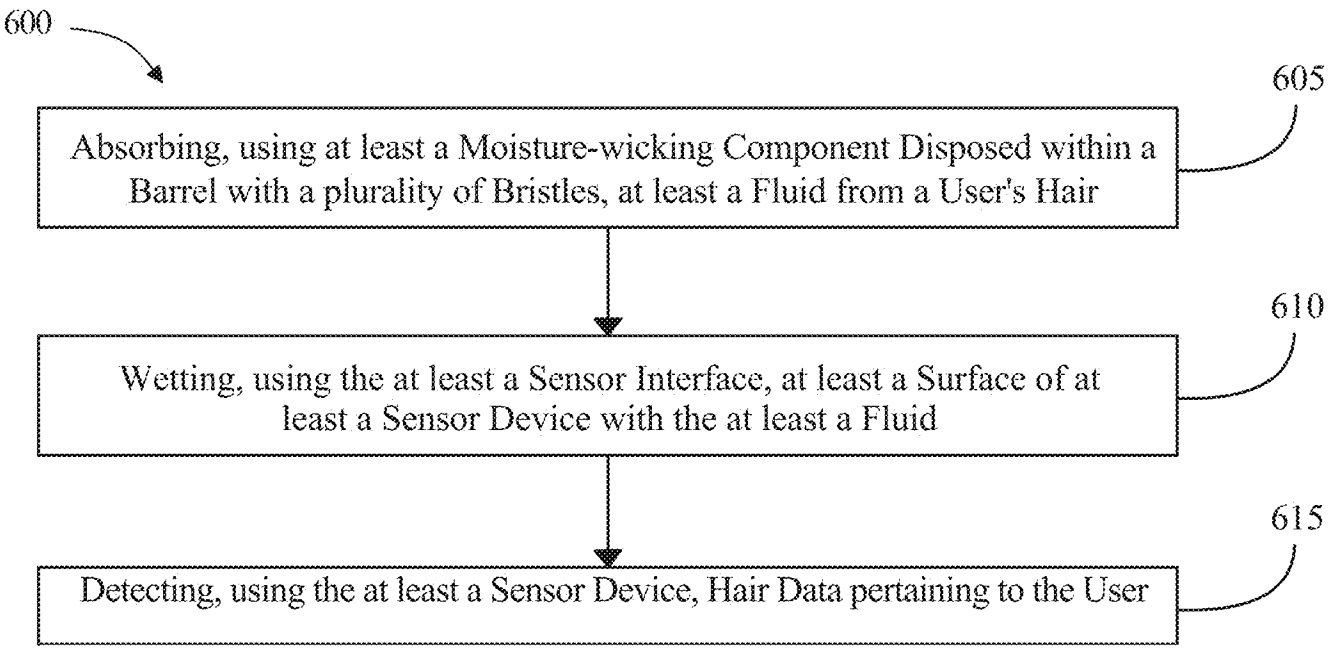
FIG. 6 is a flow diagram illustrating a method of using a hair brushing device with a hair drying capability.

Now referring to FIG. 6, an exemplary method 600 of using a hair brushing device is illustrated. Method 600 includes a step 605 of absorbing, using at least a moisture-wicking component disposed within a barrel with a plurality of bristles, at least a fluid from a user's hair. This may be implemented, without limitation, as described above in reference to FIGS. 1-5. In some embodiments, the barrel may include at least a wicking window configured to expose at least a portion of the moisture-wicking component. In some embodiments, barrel may include a barrel opening disposed to at least a surface of barrel, wherein the barrel opening is configured to enable access to the at least a moisture-wicking component. In some embodiments, the at least a moisture-wicking component may include an absorbent cushion constructed from an absorbent material. In some embodiments, the at least a moisture-wicking component may include a release mechanism configured to detach the absorbent cushion. In some embodiments, the hair brushing device may further include an external base unit comprising a light source, wherein the external base unit is configured to sterilize, using the light source, the absorbent cushion and expedite, using the light source, a drying process of the absorbent cushion. In some embodiments, the hair brushing device may further a battery, wherein the external base unit is configured to charge the battery.

With continued reference to FIG. 6, method 600 includes a step 610 of wetting, using the at least a sensor interface, at least a surface of at least a sensor device with the at least a fluid. This may be implemented, without limitation, as described above in reference to FIGS. 1-5.

With continued reference to FIG. 6, method 600 includes a step 615 of detecting, using the at least a sensor device, hair data pertaining to the user. This may be implemented, without limitation, as described above in reference to FIGS. 1-5. In some embodiments, the at least a sensor device may include a moisture sensor configured to detect moisture data. In some embodiments, the sensor device may include a temperature sensor configured to detect temperature data. In some embodiments, the hair brushing device may further include a computing device configured to receive the hair data from the at least a sensor device, transmit the hair data to a hair drying device communicatively connected to the hair bushing device, and adjust at least one hair drying parameter of the hair drying device as a function of the hair data.

It is to be noted that any one or more of the aspects and embodiments described herein may be conveniently implemented using one or more machines (e.g., one or more computing devices that are utilized as a user computing device for an electronic document, one or more server devices, such as a document server, etc.) programmed according to the teachings of the present specification, as will be apparent to those of ordinary skill in the computer art. Appropriate software coding can readily be prepared by skilled programmers based on the teachings of the present disclosure, as will be apparent to those of ordinary skill in the software art. Aspects and implementations discussed above employing software and/or software modules may also include appropriate hardware for assisting in the implementation of the machine executable instructions of the software and/or software module.

Such software may be a computer program product that employs a machine-readable storage medium. A machine-readable storage medium may be any medium that is capable of storing and/or encoding a sequence of instructions for execution by a machine (e.g., a computing device) and that causes the machine to perform any one of the methodologies and/or embodiments described herein. Examples of a machine-readable storage medium include, but are not limited to, a magnetic disk, an optical disc (e.g., CD, CD-R, DVD, DVD-R, etc.), a magneto-optical disk, a read-only memory "ROM" device, a random-access memory "RAM" device, a magnetic card, an optical card, a solid-state memory device, an EPROM, an EEPROM, and any combinations thereof. A machine-readable medium, as used herein, is intended to include a single medium as well as a collection of physically separate media, such as, for example, a collection of compact discs or one or more hard disk drives in combination with a computer memory. As used herein, a machine-readable storage medium does not include transitory forms of signal transmission.

Such software may also include information (e.g., data) carried as a data signal on a data carrier, such as a carrier wave. For example, machine-executable information may be included as a data-carrying signal embodied in a data carrier in which the signal encodes a sequence of instruction, or portion thereof, for execution by a machine (e.g., a computing device) and any related information (e.g., data structures and data) that causes the machine to perform any one of the methodologies and/or embodiments described herein.

Examples of a computing device include, but are not limited to, an electronic book reading device, a computer workstation, a terminal computer, a server computer, a handheld device (e.g., a tablet computer, a smartphone, etc.), a web appliance, a network router, a network switch, a network bridge, any machine capable of executing a sequence of instructions that specify an action to be taken by that machine, and any combinations thereof. In one example, a computing device may include and/or be included in a kiosk.

Figure 7:
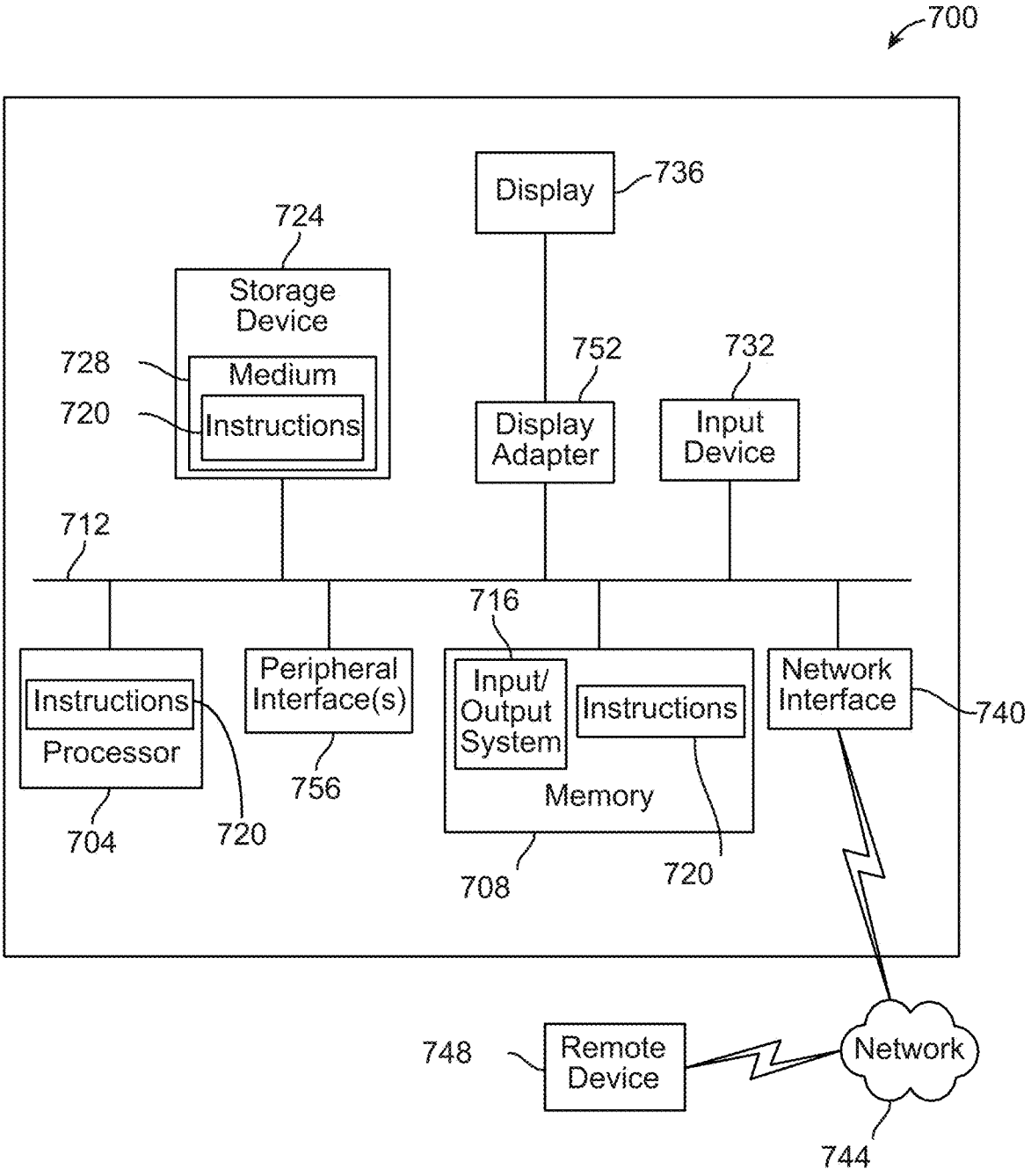
FIG. 7 is a block diagram of a computing system that can be used to implement any one or more of the methodologies disclosed herein and any one or more portions thereof.

FIG. 7 shows a diagrammatic representation of one embodiment of a computing device in the exemplary form of a computer system 700 within which a set of instructions for causing a control system to perform any one or more of the aspects and/or methodologies of the present disclosure may be executed. It is also contemplated that multiple computing devices may be utilized to implement a specially configured set of instructions for causing one or more of the devices to perform any one or more of the aspects and/or methodologies of the present disclosure. Computer system 700 includes a processor 704 and a memory 708 that communicate with each other, and with other components, via a bus 712. Bus 712 may include any of several types of bus structures including, but not limited to, a memory bus, a memory controller, a peripheral bus, a local bus, and any combinations thereof, using any of a variety of bus architectures.

Processor 704 may include any suitable processor, such as without limitation a processor incorporating logical circuitry for performing arithmetic and logical operations, such as an arithmetic and logic unit (ALU), which may be regulated with a state machine and directed by operational inputs from memory and/or sensors; processor 704 may be organized according to Von Neumann and/or Harvard architecture as a non-limiting example. Processor 704 may include, incorporate, and/or be incorporated in, without limitation, a microcontroller, microprocessor, digital signal processor (DSP), Field Programmable Gate Array (FPGA), Complex Programmable Logic Device (CPLD), Graphical Processing Unit (GPU), general purpose GPU, Tensor Processing Unit (TPU), analog or mixed signal processor, Trusted Platform Module (TPM), a floating-point unit (FPU), and/or system on a chip (SoC).

Memory 708 may include various components (e.g., machine-readable media) including, but not limited to, a random-access memory component, a read only component, and any combinations thereof. In one example, a basic input/output system 716 (BIOS), including basic routines that help to transfer information between elements within computer system 700, such as during start-up, may be stored in memory 708. Memory 708 may also include (e.g., stored on one or more machine-readable media) instructions (e.g., software) 720 embodying any one or more of the aspects and/or methodologies of the present disclosure. In another example, memory 708 may further include any number of program modules including, but not limited to, an operating system, one or more application programs, other program modules, program data, and any combinations thereof.

Computer system 700 may also include a storage device 724. Examples of a storage device (e.g., storage device 724) include, but are not limited to, a hard disk drive, a magnetic disk drive, an optical disc drive in combination with an optical medium, a solid-state memory device, and any combinations thereof. Storage device 724 may be connected to bus 712 by an appropriate interface (not shown). Example interfaces include, but are not limited to, SCSI, advanced technology attachment (ATA), serial ATA, universal serial bus (USB), IEEE 1394 (FIREWIRE), and any combinations thereof. In one example, storage device 724 (or one or more components thereof) may be removably interfaced with computer system 700 (e.g., via an external port connector (not shown)). Particularly, storage device 724 and an associated machine-readable medium 728 may provide nonvolatile and/or volatile storage of machine-readable instructions, data structures, program modules, and/or other data for computer system 700. In one example, software 720 may reside, completely or partially, within machine-readable medium 728. In another example, software 720 may reside, completely or partially, within processor 704.

Computer system 700 may also include an input device 732. In one example, a user of computer system 700 may enter commands and/or other information into computer system 700 via input device 732. Examples of an input device 732 include, but are not limited to, an alpha-numeric input device (e.g., a keyboard), a pointing device, a joystick, a gamepad, an audio input device (e.g., a microphone, a voice response system, etc.), a cursor control device (e.g., a mouse), a touchpad, an optical scanner, a video capture device (e.g., a still camera, a video camera), a touchscreen, and any combinations thereof. Input device 732 may be interfaced to bus 712 via any of a variety of interfaces (not shown) including, but not limited to, a serial interface, a parallel interface, a game port, a USB interface, a FIREWIRE interface, a direct interface to bus 712, and any combinations thereof. Input device 732 may include a touch screen interface that may be a part of or separate from display 736, discussed further below. Input device 732 may be utilized as a user selection device for selecting one or more graphical representations in a graphical interface as described above.

A user may also input commands and/or other information to computer system 700 via storage device 724 (e.g., a removable disk drive, a flash drive, etc.) and/or network interface device 740. A network interface device, such as network interface device 740, may be utilized for connecting computer system 700 to one or more of a variety of networks, such as network 744, and one or more remote devices 748 connected thereto. Examples of a network interface device include, but are not limited to, a network interface card (e.g., a mobile network interface card, a LAN card), a modem, and any combination thereof. Examples of a network include, but are not limited to, a wide area network (e.g., the Internet, an enterprise network), a local area network (e.g., a network associated with an office, a building, a campus or other relatively small geographic space), a telephone network, a data network associated with a telephone/voice provider (e.g., a mobile communications provider data and/or voice network), a direct connection between two computing devices, and any combinations thereof. A network, such as network 744, may employ a wired and/or a wireless mode of communication. In general, any network topology may be used. Information (e.g., data, software 720, etc.) may be communicated to and/or from computer system 700 via network interface device 740.

Computer system 700 may further include a video display adapter 752 for communicating a displayable image to a display device, such as display device 736. Examples of a display device include, but are not limited to, a liquid crystal display (LCD), a cathode ray tube (CRT), a plasma display, a light emitting diode (LED) display, and any combinations thereof. Display adapter 752 and display device 736 may be utilized in combination with processor 704 to provide graphical representations of aspects of the present disclosure. In addition to a display device, computer system 700 may include one or more other peripheral output devices including, but not limited to, an audio speaker, a printer, and any combinations thereof. Such peripheral output devices may be connected to bus 712 via a peripheral interface 756. Examples of a peripheral interface include, but are not limited to, a serial port, a USB connection, a FIREWIRE connection, a parallel connection, and any combinations thereof.

The foregoing has been a detailed description of illustrative embodiments of the invention. Various modifications and additions can be made without departing from the spirit and scope of this invention. Features of each of the various embodiments described above may be combined with features of other described embodiments as appropriate in order to provide a multiplicity of feature combinations in associated new embodiments. Furthermore, while the foregoing describes a number of separate embodiments, what has been described herein is merely illustrative of the application of the principles of the present invention. Additionally, although particular methods herein may be illustrated and/or described as being performed in a specific order, the ordering is highly variable within ordinary skill to achieve methods, systems, and software according to the present disclosure. Accordingly, this description is meant to be taken only by way of example, and not to otherwise limit the scope of this invention.

Exemplary embodiments have been disclosed above and illustrated in the accompanying drawings. It will be understood by those skilled in the art that various changes, omissions, and additions may be made to that which is specifically disclosed herein without departing from the spirit and scope of the present invention.

What is claimed is:

1. A hair brushing device with a hair drying capability, the hair brushing device comprising:

a brush head, wherein the brush head comprises:

at least a sensor device configured to detect hair data pertaining to a user;

a barrel with a plurality of bristles;

at least a moisture-wicking component disposed within the barrel, wherein the at least a moisture-wicking component is configured to absorb at least a fluid from the user's hair and comprises an absorbent cushion constructed from an absorbent material, wherein the barrel comprises at least a wicking window configured to expose at least a portion of the at least a moisture-wicking component, wherein the wicking window comprises a closing mechanism with a sliding cover and configured to open and close the wicking window; and at least a sensor interface configured to wet at least a surface of the at least a sensor device with the at least a fluid; and a brush handle attached to one end of the brush head, wherein the brush handle is configured to be held by the user.

2. The hair brushing device of claim 1, wherein the barrel comprises a barrel opening disposed on at least a surface of the barrel, wherein the barrel opening is configured to:

enable the user to remove the at least a moisture-wicking component from the barrel.

3. The hair brushing device of claim 1, wherein the at least a moisture-wicking component comprises a release mechanism configured to detach the absorbent cushion from the at least a moisture-wicking component.

4. The hair brushing device of claim 1, wherein the hair brushing device further comprises:

an external base unit comprising a light source, wherein the external base unit is configured to:

sterilize, using the light source, the absorbent cushion; and expedite, using the light source, a drying process of the absorbent cushion.

5. The hair brushing device of claim 4, wherein the hair brushing device further comprises:

a battery, wherein the external base unit is configured to charge the battery.

6. The hair brushing device of claim 1, wherein the at least a sensor device comprises:

a moisture sensor configured to detect moisture data.

7. The hair brushing device of claim 1, wherein the at least a sensor device comprises:

a temperature sensor configured to detect temperature data.

8. The hair brushing device of claim 1, wherein the hair brushing device further comprises a computing device configured to:

receive the hair data from the at least a sensor device;

transmit the hair data to a hair drying device communicatively connected to the hair bushing device; and adjust at least one hair drying parameter of the hair drying device as a function of the hair data.

9. A method for using a hair brushing device with a hair drying capability, the method comprising:

absorbing, using at least a moisture-wicking component comprising an absorbent cushion constructed from an absorbent material and disposed within a barrel, at least a fluid from a user's hair, wherein the barrel comprises:

a plurality of bristles; and at least a wicking window configured to expose at least a portion of the at least a moisture-wicking component, wherein the wicking window comprises a closing mechanism with a sliding cover and is configured to open and close the wicking window;

wetting, using at least a sensor interface, at least a surface of at least a sensor device with the at least a fluid; and detecting, using the at least a sensor device, hair data pertaining to the user.

10. The method of claim 9, wherein the barrel comprises a barrel opening disposed on at least a surface of the barrel, wherein the barrel opening is configured to:

enable the user to remove the at least a moisture-wicking component from the barrel.

11. The method of claim 9, wherein the at least a moisture-wicking component comprises a release mechanism configured to detach the absorbent cushion from the at least a moisture-wicking component.

12. The method of claim 9, wherein the hair brushing device comprises:

an external base unit comprising a light source, wherein the external base unit is configured to:

sterilize, using the light source, the absorbent cushion; and expedite, using the light source, a drying process of the absorbent cushion.

13. The method of claim 12, wherein the hair brushing device comprises:

a battery, wherein the external base unit is configured to charge the battery.

14. The method of claim 9, wherein the at least a sensor device comprises:

a moisture sensor configured to detect moisture data.

15. The method of claim 9, wherein the at least a sensor device comprises:

a temperature sensor configured to detect temperature data.

16. The method of claim 9, wherein the hair brushing device comprises:

a computing device configured to:

receive the hair data from the at least a sensor device;

transmit the hair data to a hair drying device communicatively connected to the hair bushing device; and adjust at least one hair drying parameter of the hair drying device as a function of the hair data.

* * * * *